US007539426B2

(12) United States Patent
Tsukada et al.

(10) Patent No.: US 7,539,426 B2
(45) Date of Patent: May 26, 2009

(54) IMAGE FORMING APPARATUS HAVING A TONER CONCENTRATION SENSOR

(75) Inventors: Shigeru Tsukada, Ebina (JP); Shunichiro Shishikura, Ebina (JP); Naoya Yamasaki, Ebina (JP); Masayuki Aratake, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/149,077

(22) Filed: Apr. 25, 2008

(65) Prior Publication Data

US 2008/0205922 A1 Aug. 28, 2008

Related U.S. Application Data

(62) Division of application No. 11/392,554, filed on Mar. 30, 2006, now Pat. No. 7,389,059.

(30) Foreign Application Priority Data

Jun. 27, 2005 (JP) ..... P.2005-185950
Jun. 27, 2005 (JP) ..... P.2005-185951

(51) Int. Cl.
*G03G 15/01* (2006.01)
*G03G 15/08* (2006.01)

(52) U.S. Cl. ..... 399/30; 399/227

(58) Field of Classification Search ..... 399/227, 399/226, 27, 30, 58, 61, 62
See application file for complete search history.

(56) References Cited

U.S. PATENT DOCUMENTS

2003/0091370 A1 5/2003 Ono ..... 399/226
2004/0146316 A1 7/2004 Yamada et al. ..... 399/227
2005/0100355 A1* 5/2005 Suzuki et al. ..... 399/27
2005/0129418 A1 6/2005 Imamiya et al. ..... 399/27
2005/0158080 A1 7/2005 Wakahara ..... 399/227
2005/0220460 A1 10/2005 Taguchi et al. ..... 399/27 X
2006/0291873 A1 12/2006 Shishikura et al. ..... 399/27 X
2006/0291878 A1 12/2006 Shishikura et al. ..... 399/27

FOREIGN PATENT DOCUMENTS

CN 1627199 A 9/2004
JP A-2001-34056 2/2001
JP 2001-066844 A * 3/2001
JP A-2001-66873 3/2001
JP A-2004-271956 9/2004

* cited by examiner

*Primary Examiner*—Sophia S Chen
(74) *Attorney, Agent, or Firm*—Morgan, Lewis & Bockius LLP

(57) ABSTRACT

An image forming apparatus includes an image carrier on which an electrostatic latent image is formed, a rotary developing device having N developer carriers on a rotation orbit and moving the N developer carriers to a development position opposite to the image carrier, and a toner concentration sensor that measures toner concentrations of the developers. A measurement position of the toner concentration sensor is set on a second virtual straight line having a first angle toward a first virtual straight line that connects a rotation center of the rotary developing device and the development position. The N developer carriers are placed in turn in an order at the same angular interval as the first angle, and an angular interval between the N-th and first developer carriers is set to a second angle greater than the first angle.

6 Claims, 24 Drawing Sheets

IMAGE FORMING APPARATUS HAVING A TONER CONCENTRATION SENSOR

This application is a divisional of U.S. application Ser. No. 11/392,554, filed Mar. 30, 2006 now U.S. Pat. No. 7,389,059. The entire contents of the application are incorporated herein by reference. This application claims priority under 35 U.S.C.§119(a) on Patent Application Nos. 2005-185950 and 2005-185951 filed in Japan on Jun. 27, 2005, the entire contents of which are hereby incorporated by reference.

BACKGROUND

1. Technical Field

The present invention relates to an image forming apparatus that includes a rotary developing device.

2. Related Art

In an image forming apparatus of full colors for forming an image in accordance with an electronic photograph method, such as a copier, a printer, a multiple function processor or the like, there is an apparatus that includes a rotary developing device which integrally has four developing devices corresponding to respective colors of K (black), C (cyan), M (magenta) and Y (yellow). In the rotary developing device, one developing roll is installed for each developing device.

When the image forming apparatus including the rotary developing device is used to form a full-color image, it is necessary to rotationally drive the rotary developing device and consequently move the respective developing rolls in turn to a development position opposite an image carrier and then switch the development colors. In that case, the positional relationship (angle allocation) where the developing rolls for the respective colors, the toner concentration sensor and the concentration standard member as mentioned above are placed in the rotation direction (around the rotation axis) of the rotary developing device becomes the largest factor in determining the productivity of the image formation. In particular, in a case where on the rotation orbit of the rotary developing device, the angular interval between some of the developing rolls is made wider than the other units, when the rotation of the rotary developing device is stopped so as to move the respective developing rolls in turn to the development position, the stop positions of the placed developing rolls except the development position become discrete. For this reason, unless the positional relationship to the toner concentration sensor and the concentration standard member is properly set, there are fears that the rotation drive control of the rotary developing device is becomes complicated and that the productivity of the image formation is extremely reduced.

SUMMARY

According to an aspect of the present embodiment, an image forming apparatus includes an image carrier on which an electrostatic latent image is formed, a rotary developing device having N developer carriers on an rotation orbit, the developer carriers carrying developers to develop the electrostatic latent image, and the rotary developing device moves in turn the N developer carriers to a development position opposite to the image carrier, and a toner concentration sensor that measures toner concentrations of the developers carried in the developer carriers. A measurement position of the toner concentration sensor is set on the second virtual straight line, the second virtual straight line having a first angle toward a first virtual straight line in an opposite direction to a rotation direction of the rotary developing device, the first virtual straight line connects a rotation center of the rotary developing device and the development position. The N developer carriers are placed in turn in an order starting from a first developer carrier to an N-th developer carrier at the same angular interval as the first angle in the opposite direction to the rotation direction of the rotary developing device, and an angular interval between the N-th developer carrier and the first developer carrier is set to a second angle greater than the first angle.

According to another aspect of the present embodiment, an image forming apparatus includes an image carrier on which an electrostatic latent image is formed, a rotary developing device having N developer carriers on a rotation orbit, the N developer carriers carrying developers to develop the electrostatic latent image, and the rotary developing device moves in turn the N developer carriers to a development position opposite to the image carrier, and a toner concentration sensor that measures toner concentrations of the developers carried in the developer carriers. The N developer carriers are placed in turn in an order starting from a first developer carrier to an N-th developer carrier at an interval of a first angle in an opposite direction to a rotation direction of the rotary developing device, and an angular interval between the N-th developer carrier and the first developer carrier is set to a second angle greater than the first angle, and a home position of the rotary developing device is set at a position separated at the same angle as the first angle in the rotation direction of the rotary developing device from the first developer carrier. A measurement position of the toner concentration sensor is set on the second virtual straight line, the second virtual straight line has an angle equal to two times the first angle toward a first virtual straight line in an opposite direction to the rotation direction of the rotary developing device, the first virtual straight line connects a rotation center of the rotary developing device and the development position.

According to yet another aspect of the present embodiment, an image forming apparatus includes an image carrier on which an electrostatic latent image is formed, a rotary developing device having N developer carriers on a rotation orbit, the developer carriers carrying developers to develop the electrostatic latent image, and the rotary developing device moves in turn the N developer carriers to a development position opposite to the image carrier, and a toner concentration sensor that measures toner concentrations of the developers carried in the developer carriers. A measurement position of the toner concentration sensor is set on a second virtual straight line, the second virtual straight line has a first angle toward a first virtual straight line in an opposite direction to a rotation direction of the rotary developing device, the first virtual straight line connects a rotation center of the rotary developing device and the development position. The N developer carriers are placed in turn in an order starting from a first developer carrier to an N-th developer carrier in the opposite direction to the rotation direction of the rotary developing device, and a home position of the rotary developing device is set between the N-th developer carrier and the first developer carrier, and an angular interval between the home position and the first developer carrier, an angular interval between the first developer carrier and a second developer carrier and an angular interval between the second developer carrier and a third developer carrier are set to the same angles as the first angle, respectively.

According to still another aspect of the present invention, an image forming apparatus includes an image carrier on which an electrostatic latent image is formed, a rotary developing device having N developer carriers on a rotation orbit, the developer carriers carrying developers to develop the electrostatic latent image, and the rotary developing device moves in turn the N developer carriers to a development position opposite to the image carrier, a toner concentration sensor that measures toner concentrations of the developers carried in the developer carriers, and a concentration standard member placed together with the developer carrier on the rotation orbit of the rotary developing device in order to calibrate the toner concentration sensor. A measurement position of the toner concentration sensor is set on a second virtual straight line, the second virtual straight line has a first angle toward a first virtual straight line in an opposite direction to a rotation direction of the rotary developing device, the first virtual straight line connects a rotation center of the rotary developing device and the development position. The N developer carriers are placed in turn in an order starting from a first developer carrier to an N-th developer carrier at the same angular interval as the predetermined angle in the opposite direction to the rotation direction of the rotary developing device, and the concentration standard member is placed at a position which is separated at the same angle as the predetermined angle from the N-th developer carrier.

BRIEF DESCRIPTION OF DRAWINGS

Embodiments of the present invention will be described in detail based on the following figures, wherein.

DETAILED DESCRIPTION

The embodiment of the present invention will be described below in detail with reference to the drawings.

Figure 1:
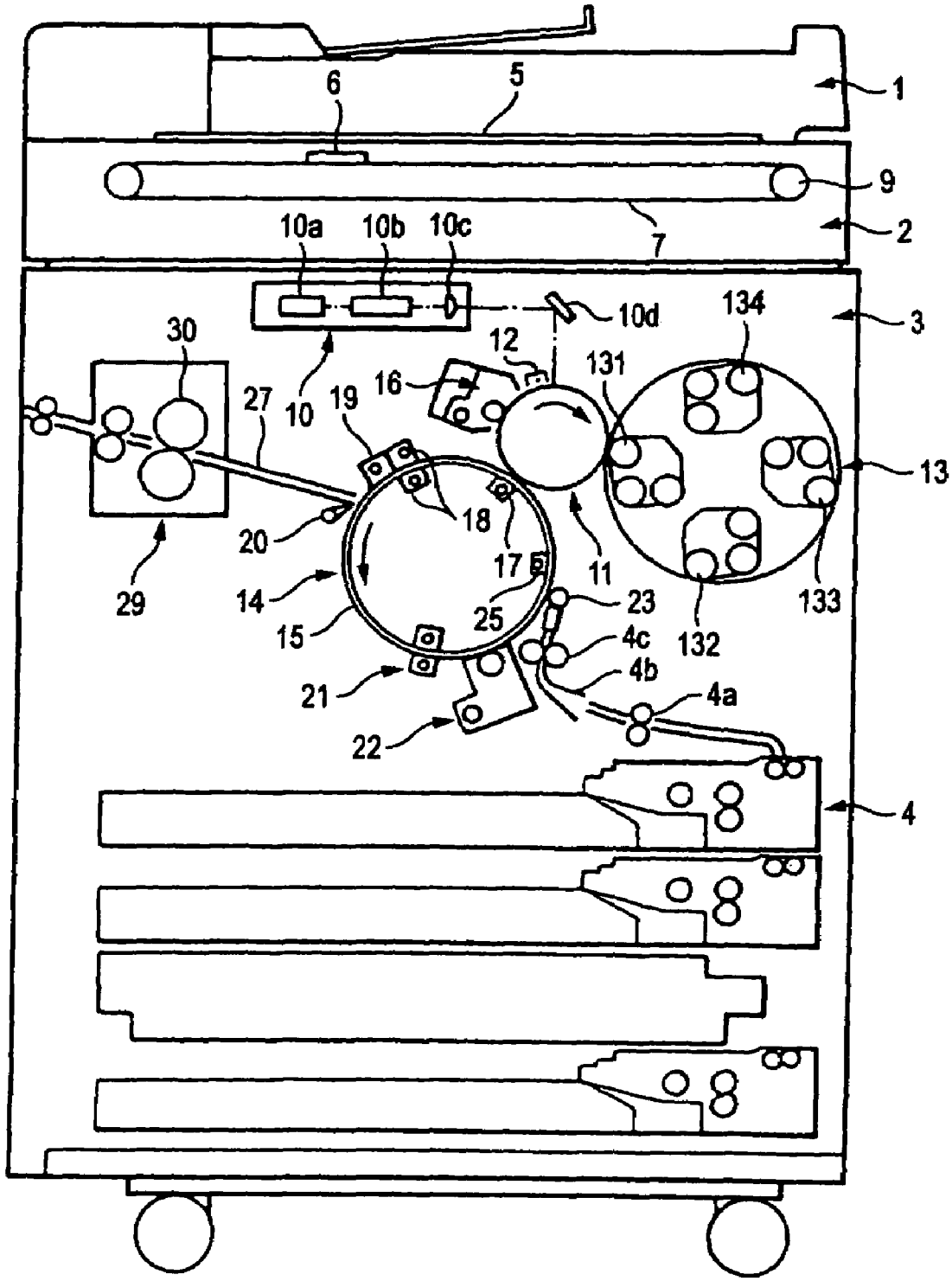
FIG. 1 is a schematic view showing a configuration example of an image forming apparatus to which the present invention is applied.

FIG. 1 is a schematic view showing the configuration example of the image forming apparatus to which the present invention is applied. This image forming apparatus is roughly provided with: a draft pushing unit 1 that integrally has an automatic draft feeder (ADF); a scanner unit 2; a printer unit 3; and a paper tray unit 4. The draft pushing unit 1 pushes a draft set in a draft base 5 from above, and it is mounted on the upper unit of the main body of the scanner unit 2 in an openable/closable manner. The draft is sent into an image reading position by the automatic draft feeder in the state that the draft pushing unit 1 is closed, or it is placed on the draft base 5 by the manual work of a user, which involves the opening/closing operation of the draft pushing unit 1.

The scanner unit 2 includes an optical scanning unit 6; a wire 7 for moving this optical scanning unit 6 to a sub-scanning direction (a right/left direction in FIG. 1); a driving pulley 9 for driving this wire 7; and a motor (not shown) for rotating this driving pulley 9. The optical scanning unit 6 optical reads and scans the image of the draft. The optical scanning unit 6 contains: a sensor (hereinafter, referred to as [Draft Reading Sensor]) for reading the draft image which is constituted by a CCD (Charge Coupled Device) line sensor with a color filter; and a light source, such as a halogen lamp for emitting the line-shaped light for reading the image to a draft surface, and the like, although they are not shown. Then, if the image of the draft has full colors, its color image is decomposed into B (Blue), G (Green) and R (Red) of the primary color of light, and read by the draft reading sensor.

Furthermore, as the configuration of the scanner unit 2, for example, when the reading line direction (the array direction of pixel rows for reading) of the draft reading sensor is defined as a main scanning direction and the direction orthogonal thereto is defined as a sub scanning direction, it is possible to employ the configuration that uses: two movement scanning bodies (carriages) where a relative ratio between movement speeds (movement distances) in the sub scanning direction is set at 1:2; optical parts (a light source lamp, a light condensing mirror, a reflection mirror and the like) mounted in those two movement scanning bodies; and a lens system for imaging the lights guided by those optical parts onto the light receiving surface of the draft reading sensor. In this case, the optical scanning unit is constituted by the foregoing two movement scanning bodies and the optical parts mounted thereon. Also, as for the foregoing two movement scanning bodies, the high speed side is referred to as a full rate carriage, and the low speed side is referred to as a half rate carriage. Then, the optical parts such as the light source lamp, the light condensing mirror, a full rate mirror and the like are mounted in the full rate carriage. The optical parts such as a pair of half rate mirrors in which a mirror plane is placed at a right angle and the like are mounted in the half rate carriage. Also, the moving method of using those two carriages is referred to as a full half rate method.

The printer unit 3 prints and outputs the image targeted for the printing to a paper. This has a laser scanning unit (laser ROS; Laser Raster Output Scanner) 10, and a light sensing body of a drum type (hereinafter referred to as [Photosensitive drum]) 11 serving as the image carrier. An electrifier 12 for uniformly electrifying the surface of the photosensitive drum 11, a rotary developing device 13 for developing an electrostatic latent image, which is written onto the surface of the photosensitive drum 11 by the laser scanning unit 10, into a toner image, a transcribing unit 14 for transcribing the toner image to the paper, and a cleaner 16 for removing the remaining toner, which is not transcribed to the paper, from the photosensitive drum 11, and the like are placed around the photosensitive drum 11.

The photosensitive drum 11 is rotationally driven in the illustrated arrow direction by the driving of the motor (not shown). At that time, the electrifier 12 uniformly electrifies the surface of the photosensitive drum 11. Also, the laser scanning unit 10 makes a laser output unit 10*a* generate a laser beam and flashes (modulates) this laser beam in accordance with the image data for the respective colors from the scanner unit 2. The laser beam outputted from the laser output unit 10*a* as mentioned above is emitted via a polygon mirror 10*b*, a f/θ lens 10*c* and a reflection lens 10*d* to the surface of the photosensitive drum 11 and also scanned in the axis direction of the photosensitive drum 11 in accordance with the rotation of the polygon mirror 10*b*. Consequently, the electrostatic latent image corresponding to the image of the draft read by the scanner unit 2 is formed on the photosensitive drum 11.

The electrostatic latent image formed on the photosensitive drum 11 as mentioned above is developed into the toner image by the rotary developing device 13, and this toner image is transcribed to the paper by the transcribing unit 14. At this time, the toner (remaining toner), which is not transcribed to the paper and remains on the photosensitive drum 11, is removed by the cleaner 16. Also, the surface of the photosensitive drum 11, which is cleaned by the cleaner 16, is again electrified by the electrifier 12. After that, the electrostatic latent images of the other colors are written to this drum surface in turn by the driving of the laser scanning unit 10.

The rotary developing device 13 is rotationally driven in the clockwise direction of the drawing by the motor (not shown). Four developing rolls 131 to 134 are placed on the rotational orbit. Each of the developing rolls 131 to 134 is rotated while holding the developer on the outer circumference surface of the roll and corresponds to [Developer carrier] in the present invention. The rotational orbit of the rotary developing device 13 implies the circular orbit where the outer circumference of the rotary developing device 13 is circumferentially moved when the rotary developing device 13 is rotated by the driving of the motor.

The rotation operation angle of the rotary developing device 13 is controlled, for example, by the following method. That is, this is designed such that a rotation plate with a slit (notch) is attached to the rotation shaft of the rotary developing device 13, and the light emitting unit and light receiving unit of a transmission type light sensor are placed so as to sandwich the slit portion of this rotation plate between both sides, and consequently, for each rotation of the rotary developing device 13, one sensor signal at one time is outputted at a certain rotation angle from the transmission type light sensor. Also, this is designed such that a pulse motor is employed in a rotation driving motor of the rotary developing device 13, and the rotation and stop of the rotary developing device 13 are controlled in accordance with the supply and stop of a drive pulse to the rotation driving motor, and the rotation angle of the rotary developing device 13 is controlled in accordance with the number of drive pulses supplied to the rotation driving motor. Then, the rotation angle at which the rotary developing device 13 is stopped is controlled by defining a timing when the sensor signal is outputted from the transmission type light sensor as a standard and then counting the drive pulses supplied to the rotation driving motor from this standard timing.

Here, assuming that the development color order when the full-color image is formed is set at an order of black→cyan→magenta→yellow, among the four developing rolls 131 to 134 placed in turn on the rotation orbit of the rotary developing device 13, the developing roll 131 is placed in the developing device for the black, and the developing roll 132 is placed in the developing device for the cyan. Also, the developing roll 133 is placed in the developing device for the magenta, and the developing roll 134 is placed in the developing device for the yellow. Each developing device uses a two-component developer including toner and carrier and develops the electrostatic latent image. Also, four detaching type (exchanging type) toner cartridges corresponding to the four developing devices, and toner supplementing mechanisms (augers and the like) for supplementing the toners to the developing devices from the toner cartridges are assembled in the rotary developing device 13.

When the development color at the time of the development of the electrostatic latent image (the color of the toner used in the development of the electrostatic latent image) is switched at the development position opposite the photosensitive drum 11, the rotary developing device 13 is rotated in one direction (the clockwise direction of the drawing) R. Then, when the electrostatic latent image on the photosensitive drum 11 is developed by the black toner, the developing roll 131 for the black is moved to the development position opposite the photosensitive drum 11, and when it is developed by the cyan toner, the developing roll 132 for the cyan is moved, and when it is developed by the magenta toner, the developing roll 133 for the magenta is moved, and when it is developed by the yellow toner, the developing roll 132 for the yellow is moved, respectively.

The transcribing unit 14 has a transcribing drum 15. A paper holder made of dielectric film is tensioned and placed around the outer circumference of the transcribing drum 15. The transcribing drum 15 is linked by a gear to a dedicated electric motor or a rotation driving system of the photosensitive drum 11 and rotationally driven in the arrow direction of the drawing (the counterclockwise direction). A transcribing electrifier 17, a separating discharger 18, a toner charge control electrifier 19, a stripping claw 20, a static eliminator 21, a cleaner 22, a pushing roll 23, and an absorbing electrifier 25 are placed around the transcribing drum 15. Then, the paper, which is fed from the paper tray unit 4 through a paper feeding roller 4*a* and a paper feeding guide 4*b*, waits at a register position 4*c* in order to adjust the timing for the image (toner image). After that, it is fed to the transcribing drum 15 at a predetermined timing. Then, it is absorbed by the dielectric film by the corona discharging of the absorbing electrifier 25.

The transcribing drum 15 is rotated in synchronization with the photosensitive drum 11. The toner image first developed by the black toner is transcribed to the paper wrapped around the outer circumference of the transcribing drum 15 by the transcribing electrifier 17. Moreover, with the rotation of the transcribing drum 15, sequentially, the other colors, namely, the toner images of cyan, magenta and yellow are transcribed (overlapped and transcribed). When with the four rotations of the transcribing drum 15, the toner images corresponding to the four colors are transcribed to the paper, AC static elimination is carried out by the separating dischargers 18 placed on the inner side and outer side of the transcribing drum 15. Consequently, the paper is separated by a stripping claw 20 and fed to a fixer 29 by a carrying belt 27. In the fixer 29, the toner images are melted and fixed on the paper by a thermally compressing roller 30. Additionally, when the full-color image is formed, it is necessary to use the developing rolls 131 to 134 in turn and then carry out the developing process four times. However, when the white and black image is formed, only one developing process that uses the developing roll 131 for the black is adequate.

First Embodiment

Figure 2A:
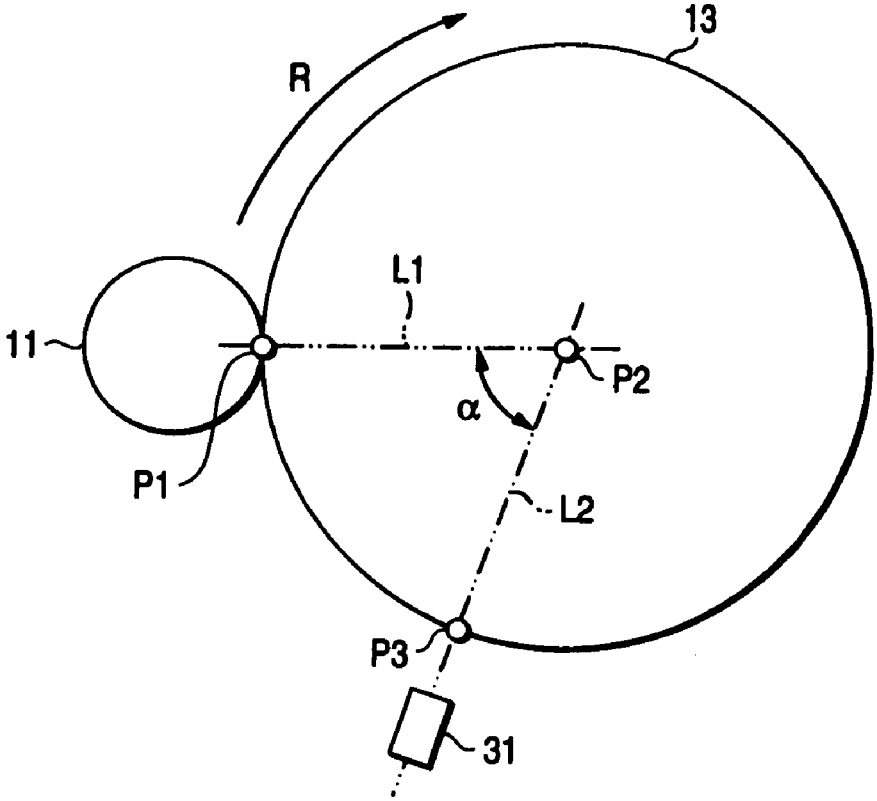
FIGS. 2A and 2B are schematic views showing a positional relationship between respective units around a rotary developing device according to a first embodiment of the present invention.
Figure 2B:
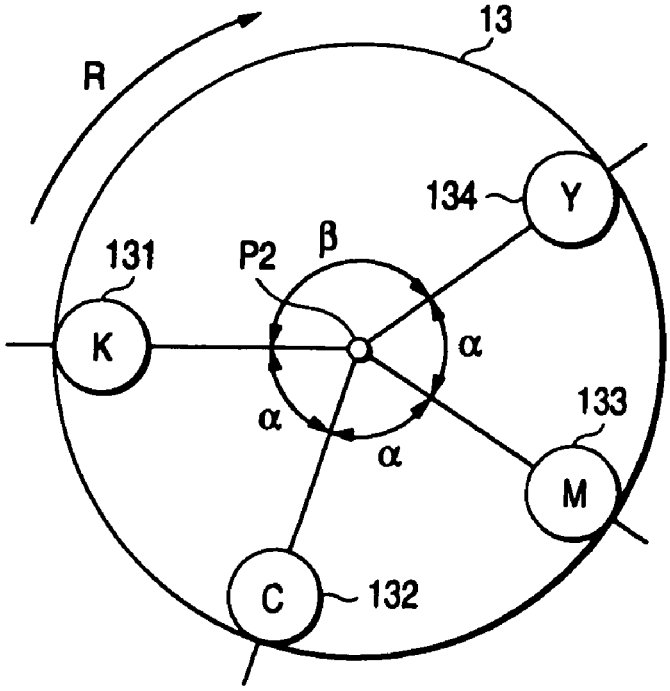

FIGS. 2A and 2B are schematic views showing the positional relationship between the respective units around the rotary developing device according to the first embodiment of the present invention. As shown in the figures, the rotary developing device 13 is placed in the state close to the photosensitive drum 1, at a development position P1 opposite the photosensitive drum 11. The development position P1 implies the position where the process for developing the electrostatic latent image formed on the photosensitive drum 11 into the toner image is actually executed.

Around (near) the rotary developing device 13, a toner concentration sensor 31 is placed opposite to the outer circumference of the rotary developing device 13. The toner concentration sensor 31 measures the toner concentration (toner mixture ratio) of the two-component developer held in each of the developing rolls 131, 132, 133 and 134. As the toner concentration sensor 31, it is possible to use an optical sensor, for example, in which a light emitting device and a light receiving device are combined. When the optical sensor is used, the reflection light from the developer held in the developing roll is received, thereby enabling the toner concentration to be measured at an optical reflectance of the developer.

Here, around the rotation axis of the rotary developing device 13, a rotation center P2 of the rotary developing device 13 and the development position P1 opposite the photosensitive drum 11 are connected by a first virtual straight line L1. Then, with the rotation center P2 from this first virtual straight line L1 as a standard, a second virtual straight line L2 is laid at a first angle $\alpha$, opposite to a rotation direction R of the rotary developing device 13, namely, counterclockwise (on the upstream side of the rotation direction R). As a result, a measurement position P3 of the toner concentration sensor 31 is set on the second virtual straight line L2. The measurement position P3 of the toner concentration sensor 31 implies the target position when the toner concentration is measured by the toner concentration sensor 31. For example, when the toner concentration sensor 31 is the optical sensor, in order to measure the optical reflectance, the position to which the light is emitted by the light emitting device of the toner concentration sensor 31 corresponds to the measurement position P3. In short, the foregoing first virtual straight line L1 and second virtual straight line L2 intersect each other at the rotation center P2. Also, the first angle $\alpha$ between the first virtual straight line L1 and the second virtual straight line L2 is set in the range of $0<\alpha<90°$.

On the contrary, the four developing rolls 131 to 134 are placed in turn at the same angular interval as the first angle $\alpha$ rotating oppositely in the rotation direction R of the rotary developing device 13 (counterclockwise) with the position of the developing roll 131 for the black as the standard (start point), on the rotation orbit of the rotary developing device 13. That is, with the rotation center P2 of the rotary developing device 13 as the standard, on the rotation orbit of the rotary developing device 13, the position of each of the developing rolls 131 to 134 is defined at the angle around the rotation axis. Then, with regard to the position of the developing roll 131 for the black, the developing roll 132 for the cyan is counterclockwise placed at the position at the first angle $\alpha$. Also, with regard to the position of the developing roll 132 for the cyan, the developing roll 133 for the magenta is counterclockwise placed at the position at the first angle $\alpha$. With regard to the position of the developing roll 133 for the magenta, the developing roll 134 for the yellow is counterclockwise placed at the position at the first angle $\alpha$. And, with regard to the position of the developing roll 134 for the yellow, the developing roll 131 for the black is counterclockwise placed at the position at a second angle $\beta$ that is greater than the first angle $\alpha$. In this case, the second angle $\beta$ is set in the range of $90°<\beta<180°$.

In accordance with the foregoing angular allocation, the respective developing rolls 131 to 134 are placed on the rotation orbit of the rotary developing device 13. Thus, around the rotation axis of the rotary developing device 13, the space wider than that between the other developing rolls is reserved between the developing roll 131 for the black and the developing roll 134 for the yellow. For example, when the capacity of the toner cartridge for the black is desired to be greater than the toner cartridges of the other colors (cyan, magenta and yellow), this can be achieved by setting the installation position of the toner cartridge for the black in the space between the developing roll 131 for the black and the developing roll 134 for the yellow, around the rotation axis of the rotary developing device 13.

Figure 3:
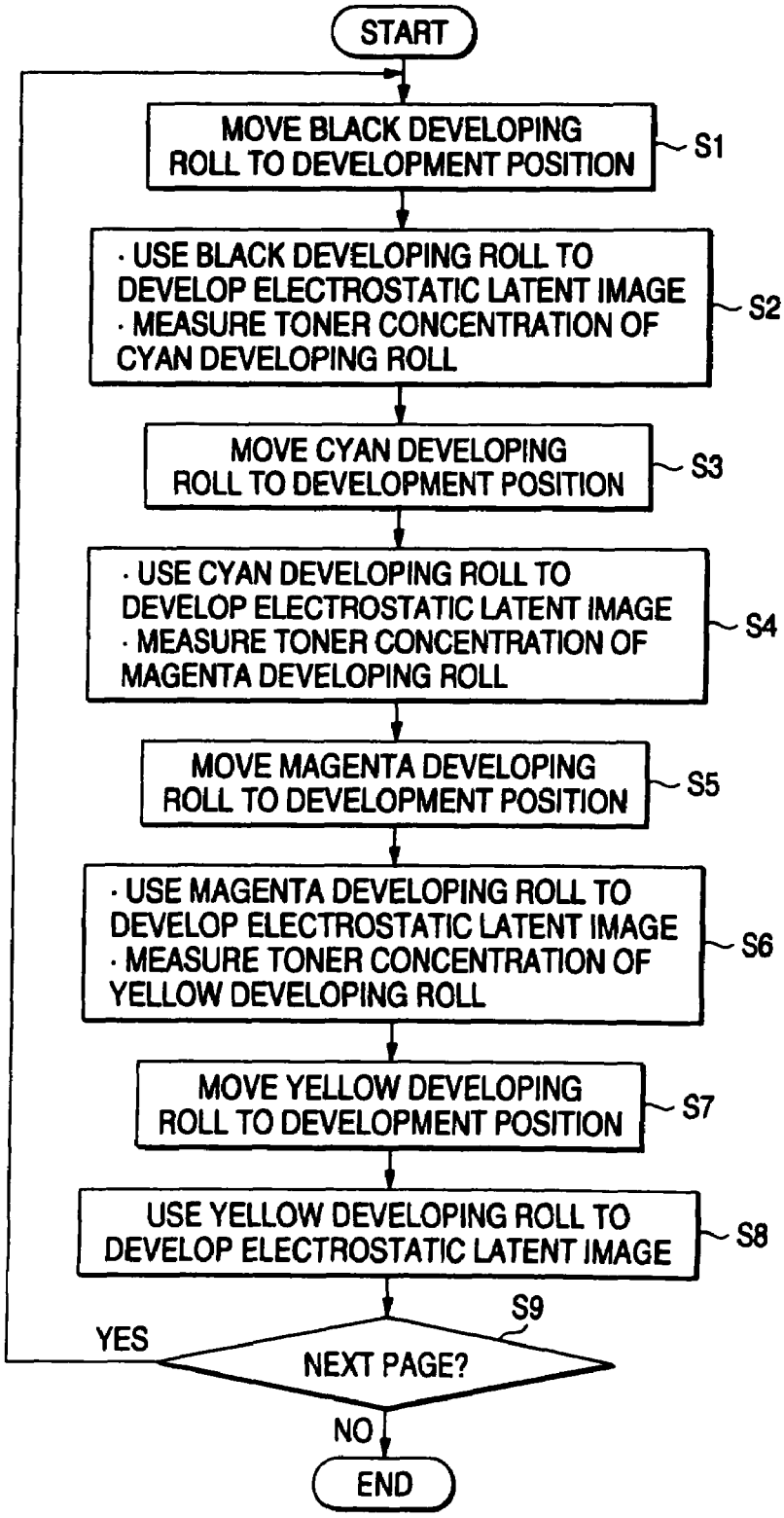
FIG. 3 is a flowchart showing a process procedure when the image forming apparatus according to the first embodiment of the present invention is used to form a full-color image.

FIG. 3 is a flowchart showing the process procedure when the image forming apparatus according to the first embodiment of the present invention is used to form the full-color image.

Figure 4A:
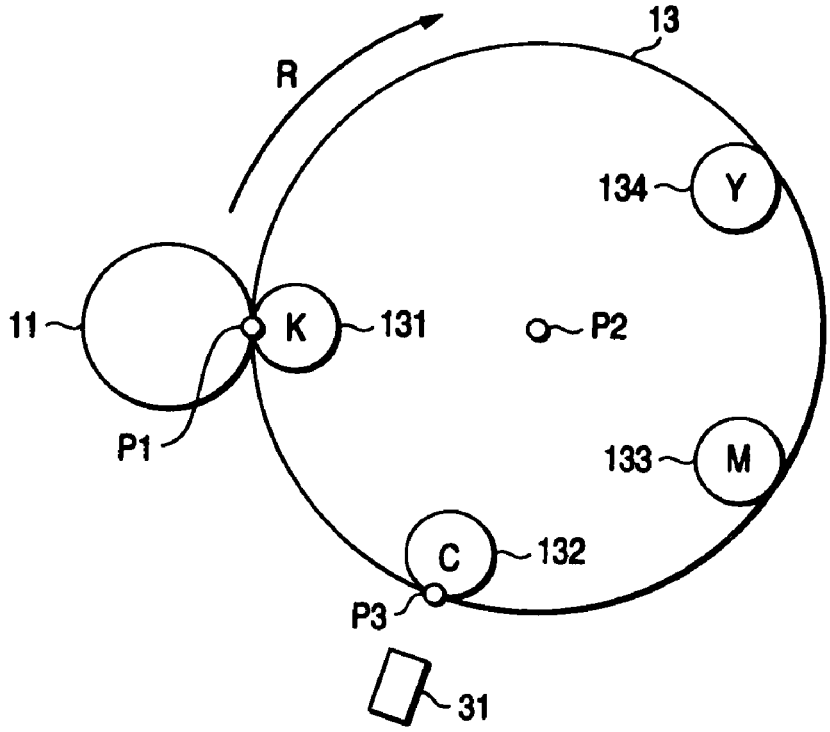
FIGS. 4A and 4B are views explaining an operation state of an image forming operation according to the first embodiment of the present invention (No. 1)

First, as shown in FIG. 4A, the developing roll 131 for the black is moved to the development position P1 (Step S1). Then, the developing roll 132 for the cyan becomes the state moved to the measurement position P3 of the toner concentration sensor 31. Thus, in this state, the developing roll 131 for the black is used to develop the electrostatic latent image on the photosensitive drum 11 into the toner image, and the toner concentration of the developing roll 132 for the cyan is measured by the toner concentration sensor 31 (Step S2).

Figure 4B:
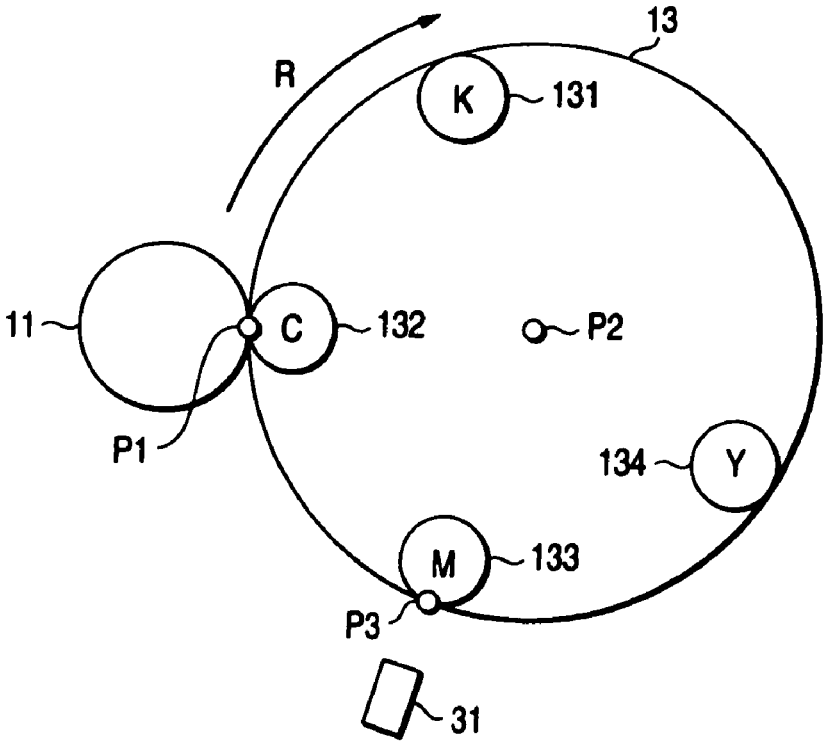

Next, from the state shown in FIG. 4A, the rotary developing device 13 is rotated in the R-direction by the first angle α. Thus, as shown in FIG. 4B, the developing roll 132 for the cyan is moved to the development position P1 (Step S3). Then, the developing roll 133 for the magenta becomes the state moved to the measurement position P3 of the toner concentration sensor 31. Hence, in this state, the developing roll 132 for the cyan is used to develop the electrostatic latent image on the photosensitive drum 11 into the toner image, and the toner concentration of the developing roll 133 for the magenta is measured by the toner concentration sensor 31 (Step S4).

Figure 5A:
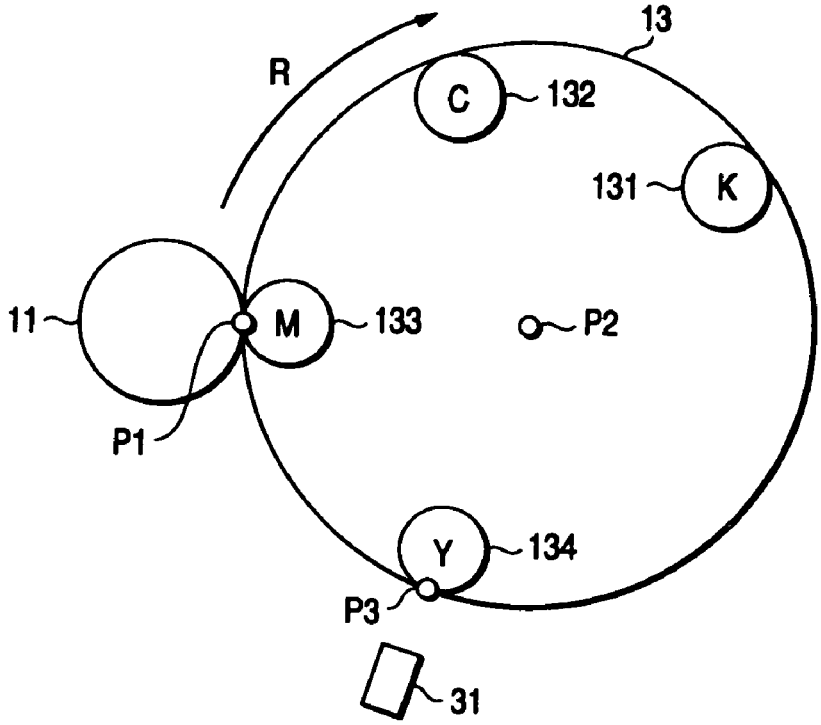
FIGS. 5A and 5B are views explaining an operation state of an image forming operation according to the first embodiment of the present invention (No. 2)

Next, from the state shown in FIG. 4B, the rotary developing device 13 is rotated in the R-direction by the first angle α. Thus, as shown in FIG. 5A, the developing roll 133 for the magenta is moved to the development position P1 (Step S5). Then, the developing roll 134 for the yellow becomes the state moved to the measurement position P3 of the toner concentration sensor 31. Hence, in this state, the developing roll 133 for the magenta is used to develop the electrostatic latent image on the photosensitive drum 11 into the toner image, and the toner concentration of the developing roll 134 for the yellow is measured by the toner concentration sensor 31 (Step S6).

Figure 5B:
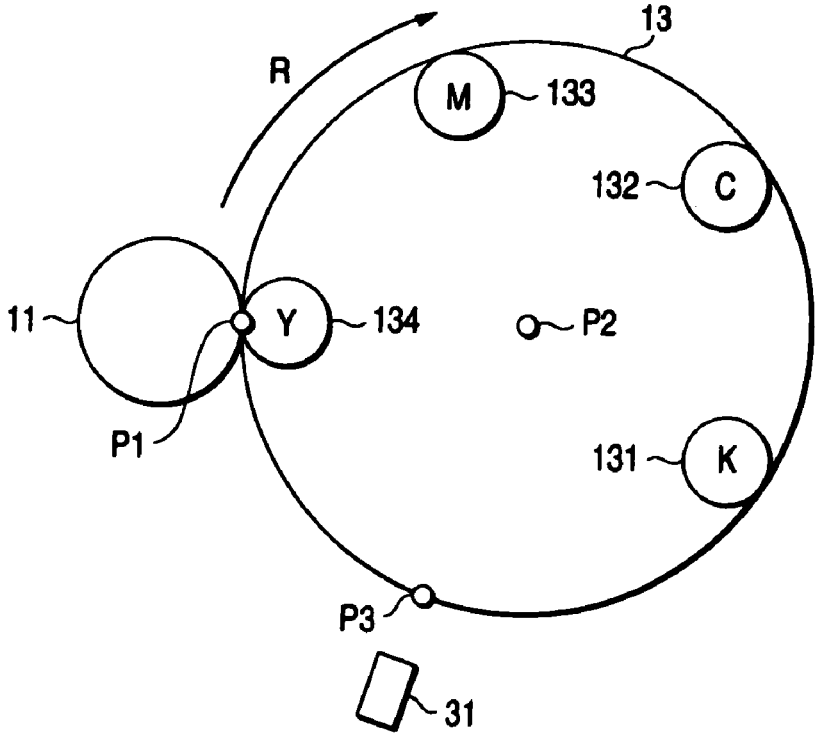

Next, from the state shown in FIG. 5A, the rotary developing device 13 is rotated in the R-direction by the first angle α. Thus, as shown in FIG. 5B, the developing roll 134 for the yellow is moved to the development position P1 (Step S7). In this state, the developing roll 134 for the yellow is used to develop the electrostatic latent image on the photosensitive drum 11 into the toner image (Step S8). As mentioned above, the operation cycle corresponding to one page related to the color image formation is ended. After that, whether or not a page on which a next image is formed remains is checked (Step S9). If it remains, the processes from the step S1 are repeated.

In this way, in the image forming apparatus according to the first embodiment of the present invention, when with the rotation driving of the rotary developing device 13, the developing roll 131 for the black is moved to the development position P1, the developing roll 132 for the cyan is placed at the measurement position P3 of the toner concentration sensor 31. Also, when the developing roll 132 for the cyan is moved to the development position P1, the developing roll 133 for the magenta is placed at the measurement position P3 of the toner concentration sensor 31. And, when the developing roll 133 for the magenta is moved to the development position P1, the developing roll 134 for the yellow is placed at the measurement position P3 of the toner concentration sensor 31.

Thus, when the developing roll 131 for the black is used to develop the electrostatic latent image on the photosensitive drum 11, the toner concentration of the developing roll 132 for the cyan can be measured by the toner concentration sensor 31. Also, when the developing roll 132 for the cyan is used to develop the electrostatic latent image on the photosensitive drum 11, the toner concentration of the developing roll 133 for the magenta can be measured by the toner concentration sensor 31. When the developing roll 133 for the magenta is used to develop the electrostatic latent image on the photosensitive drum 11, the toner concentration of the developing roll 134 for the yellow can be measured by the toner concentration sensor 31.

From the above-mentioned explanation, the toner concentrations of the developing rolls 132, 133 and 134 for the colors (cyan, magenta and yellow) can all be measured by the toner concentration sensor 31, when the developing rolls for the other colors are used to develop the electrostatic latent image. Thus, at the time of the formation of the full-color image, except for when the respective developing rolls 131 to 134 are stopped at the development position P1 for the image formation, it is not necessary to stop the rotation of the rotary developing device 13 for the purpose of measuring the toner concentration of the developing roll. In addition, during the image forming operation, the angle reference data required to control the rotation angle of the rotary developing device 13 can be made to respond to the two angles α and β. For this reason, the rotation drive control of the rotary developing device 13 is made very simple. Also, the number of times that the rotation of the rotary developing device is stopped during the image forming operation can be reduced to the minimum necessary number. Hence, the high productivity can be achieved.

Additionally, when the toner concentration of the developing roll 131 for the black is measured by the toner concentration sensor 31, the developing roll 131 for the black is required to be moved to the measurement position P3 of the toner concentration sensor 31. However, typically, the toner for the black has the property of absorbing the light similarly to the carrier mixed therewith, and the reflectance of the light is low as compared with the color toners for cyan, magenta, yellow and the like. Thus, even if the optical toner concentration sensor 31 is used to measure the toner concentration, it is difficult to obtain the sufficient sensitivity. For this reason, for the black, the concentration measurement that uses the toner concentration sensor 31 is not executed. Then, another measuring method, for example, the method of using the toner for the black and generating (developing) a standard patch on the photosensitive drum 11, and then measuring the development toner amount of this standard patch by using a sensor, and further controlling the toner supply to make the development toner amount constant may be employed. Hence, even if during the image forming operation, the toner concentration of the developing roll 131 for the black is not measured by the toner concentration sensor 31, there is no substantial problem on practical use.

Second Embodiment

Figure 6A:
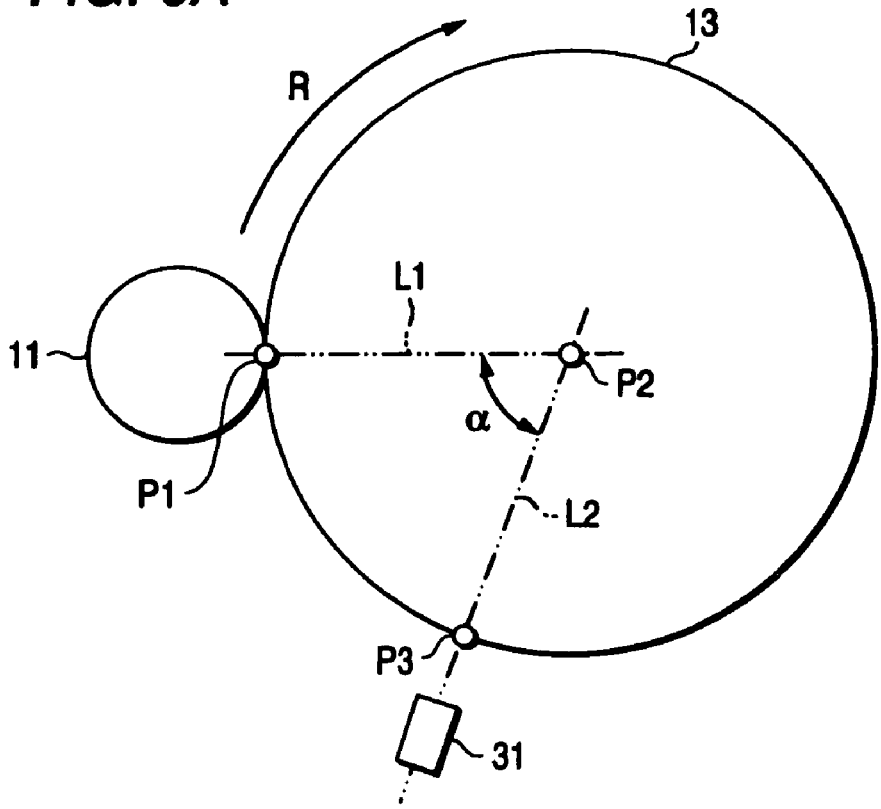
FIGS. 6A and 6B are schematic views showing a positional relationship between respective units around a rotary developing device according to a second embodiment of the present invention.
Figure 6B:
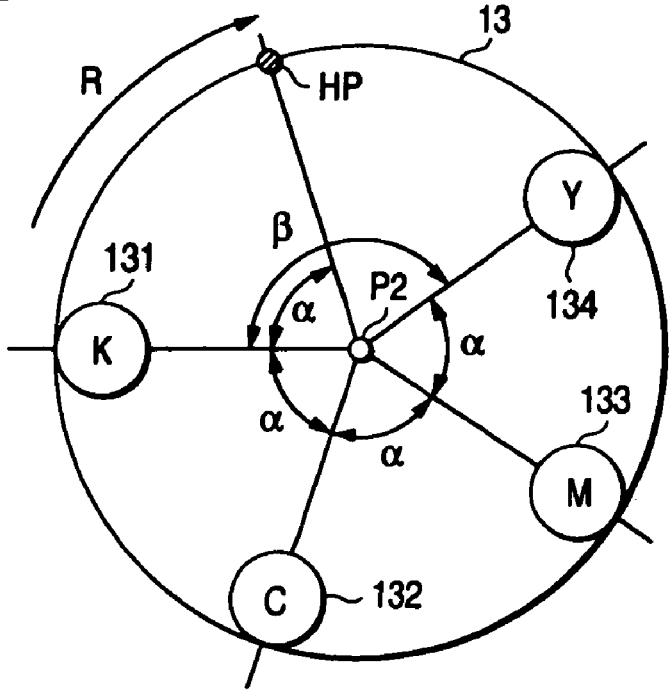

FIGS. 6A and 6B are schematic views showing the positional relationship between the respective units around the rotary developing device according to the second embodiment of the present invention. In this second embodiment, especially as compared with the first embodiment, on the rotation orbit of the rotary developing device 13, the arrangement relationship (angular allocation) between the development position P1, the measurement position P3 and the developing rolls 131 to 134 is set under the same condition. However, it is different in that on the rotation orbit of the rotary developing device 13, a home position HP of the rotary developing device 13 is set between the developing roll 131 for the black and the developing roll 134 for the yellow, and that this home position HP is set at the position which is separated at the same angle as the first angle α in the rotation direction R of the rotary developing device 13 from the developing roll 131 for the black.

The home position HP of the rotary developing device 13 implies a predetermined position (first location) on the rotation orbit of the rotary developing device 13, which is placed at the development position P1 opposite the photosensitive drum 11, when the rotation of the rotary developing device 13 is stopped before the start of the image formation or after the completion thereof. This home position HP is set at the position except for the position where the developing roll is placed, and no member exists at that position in particular. Thus, the state where the home position HP of the rotary developing device 13 is moved to the development position P1 becomes the state where a gap lies between the photosensitive drum 11 and the rotary developing device 13 (in the opposite portion).

This reason is as follows. For example, at the time of the completion of the image formation, when in a state that the developing roll for a certain color or a different member is moved to the development position P1, the rotation of the rotary developing device 13 is stopped to then maintain the situation until the start of a next image formation, if a wait time from the completion of the image formation to the start of the next image formation is long, this results in a state that the developing roll or the different member is stopped at the development position P1 for a long time. Consequently, there is a fear that the developer on the developing roll may receive stress, or the surface of the light sensing body (the external circumference surface of the drum) may be damaged when the photosensitive drum 11 is attached or detached.

Figure 7:
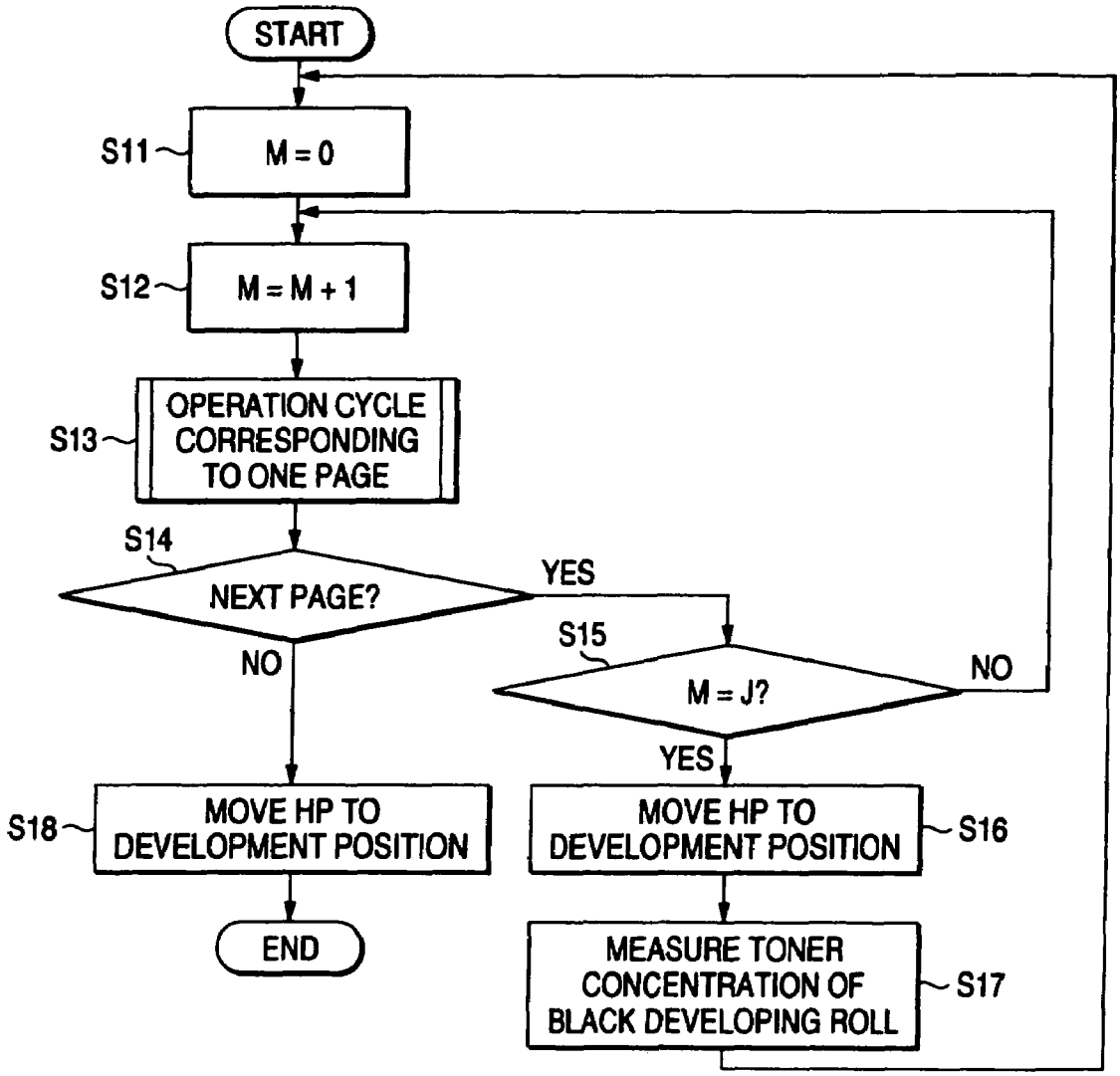
FIG. 7 is a flowchart showing a process procedure when the image forming apparatus according to the second embodiment of the present invention is used to form a full-color image.

FIG. 7 is a flowchart showing the process procedure when the image forming apparatus according to the second embodiment of the present invention is used to form the full-color image. This process procedure is carried out in accordance with a control process for an image formation controller (not shown).

First, after a value of a variable M is reset to zero (Step S11), the M value is incremented by 1 (Step S12). Next, the image is formed in accordance with an operation cycle corresponding to one page (Step S13).

Figure 8A:
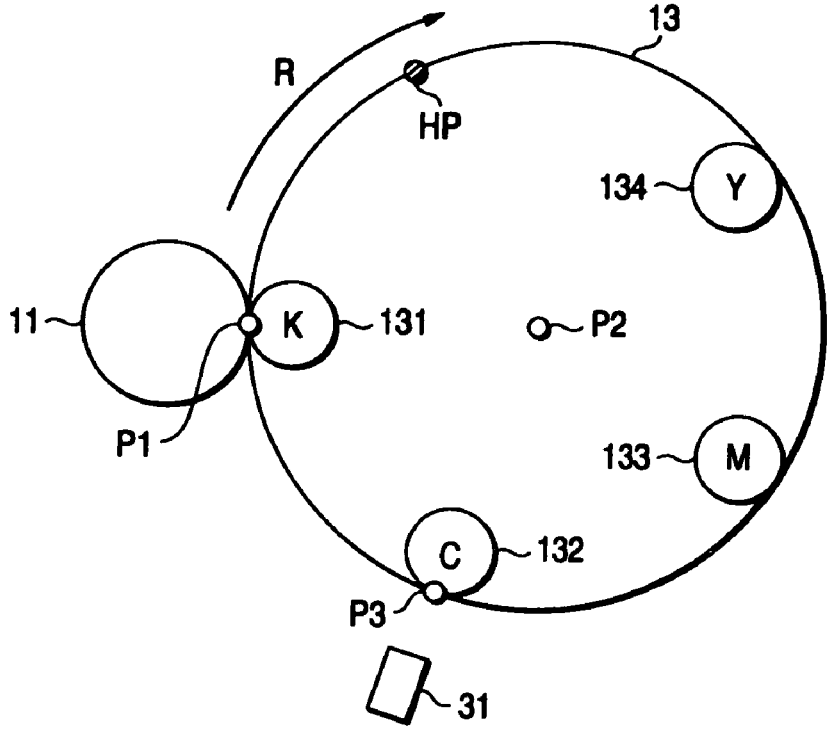
FIGS. 8A and 8B are views explaining an operation state of an image forming operation according to the second embodiment of the present invention (No. 1)
Figure 8B:
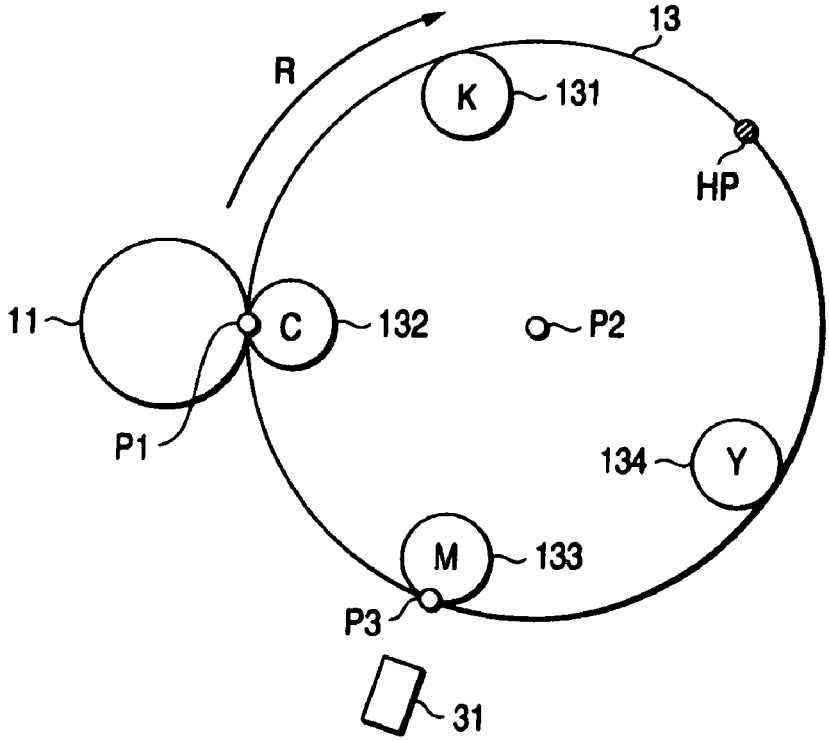
Figure 9A:
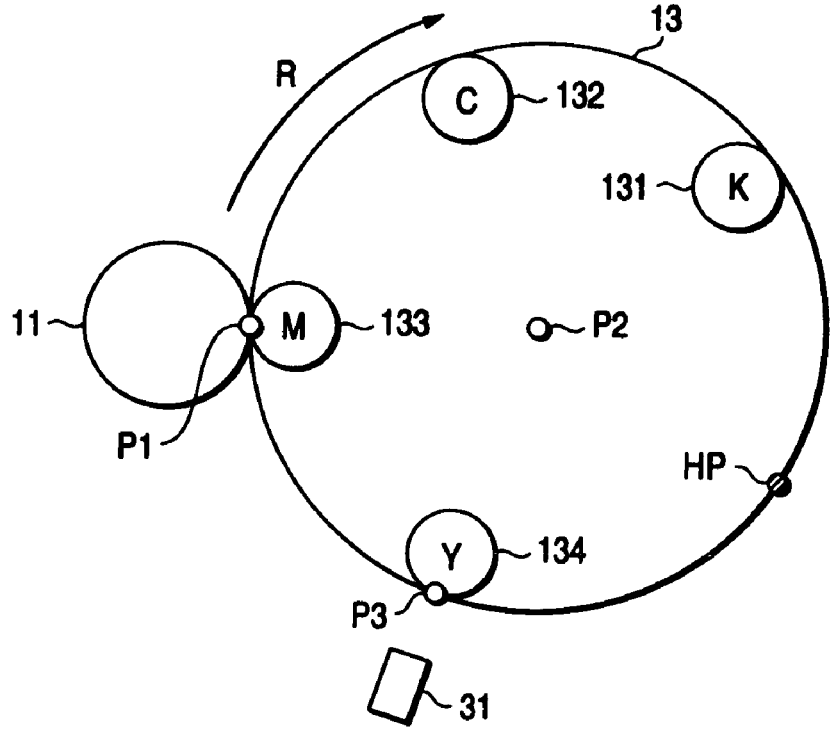
FIGS. 9A and 9B are views explaining an operation state of an image forming operation according to the second embodiment of the present invention (No. 2)

The operation cycle corresponding to one page includes the processes similar to the steps S1 to S8 shown in FIG. 3. That is, the process at the step S13 includes: a first process shown in FIG. 8A, where the developing roll 131 for the black is moved to the development position P1, and in this state, the developing roll 131 for the black is used to develop the electrostatic latent image on the photosensitive drum 11, and the toner concentration of the developing roll 132 for the cyan is measured by the toner concentration sensor 31; a second process shown in FIG. 8B, where the developing roll 132 for the cyan is moved to the development position P1, and in this state, the developing roll 132 for the cyan is used to develop the electrostatic latent image on the photosensitive drum 11 into the toner image, and the toner concentration of the developing roll 133 for the magenta is measured by the toner concentration sensor 31; a third process shown in FIG. 9A, where the developing roll 133 for the magenta is moved to the development position P1, and in this state, the developing roll 133 for the magenta is used to develop the electrostatic latent image on the photosensitive drum 11 into the toner image, and the toner concentration of the developing roll 134 for the yellow is measured by the toner concentration sensor 31; and a fourth process shown in FIG. 9B, where the developing roll 134 for the yellow is moved to the development position P1, and in this state, the developing roll 134 for the yellow is used to develop the electrostatic latent image on the photosensitive drum 11 into the toner image.

Subsequently, whether or not a page on which a next image is formed remains is checked (Step S14). If the next page remains, whether or not a current M value reaches a preset predetermined value J is judged (Step S15). Then, if the M value does not reach the predetermined value J, the operational flow returns to the step S112. The predetermined value J can be set at any value.

Figure 9B:
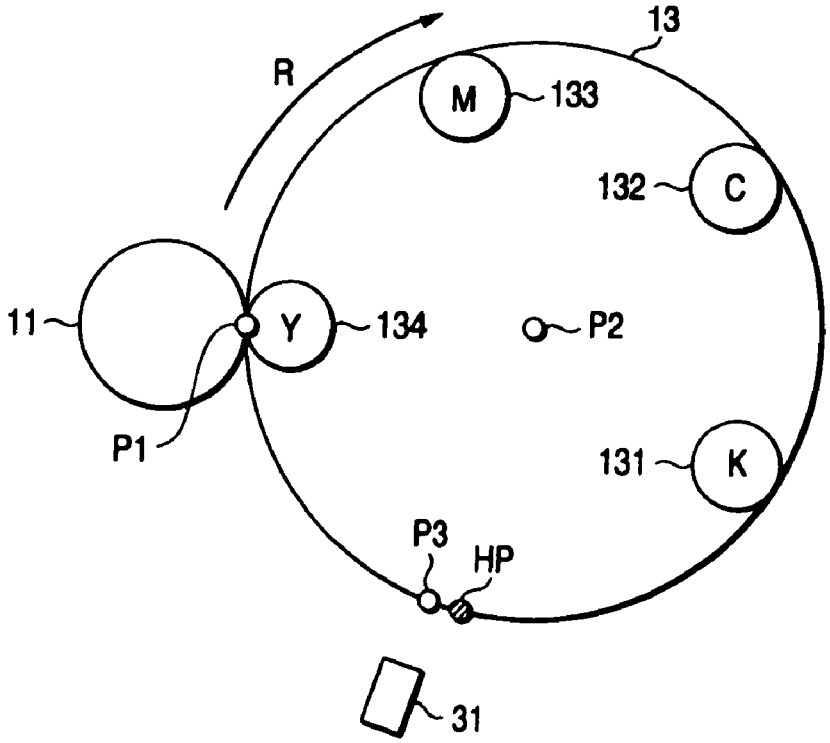
Figure 10:
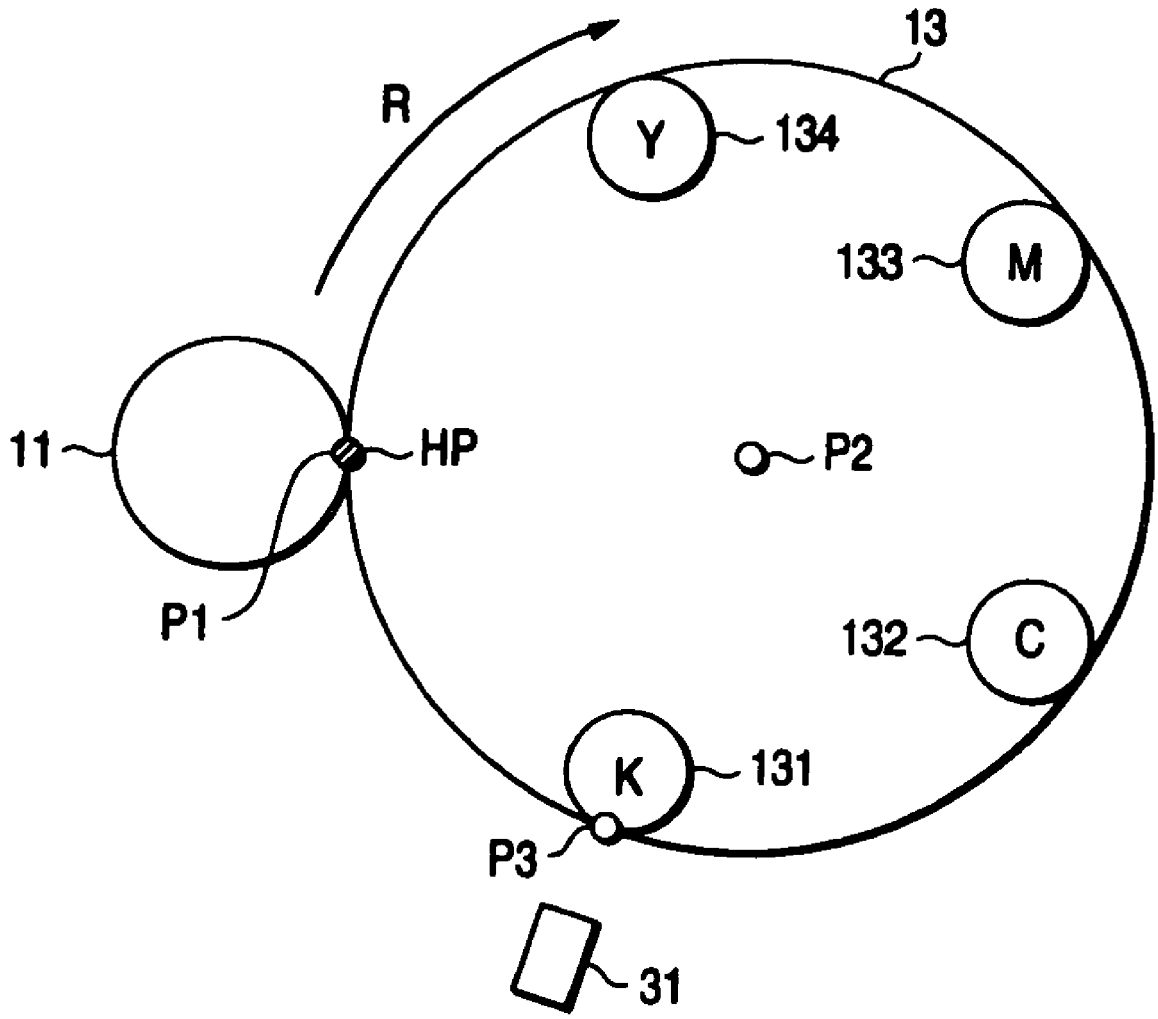
FIG. 10 is a view explaining an operation state of an image forming operation according to the second embodiment of the present invention (No. 3)

On the contrary, if the M value reaches (coincides with) the predetermined value J, the rotary developing device 13 is rotated by a predetermined angle (=$\beta-\alpha$) in the R-direction from the state shown in FIG. 9B. Thus, as shown in FIG. 10, the home position HP of the rotary developing device 13 is moved to the development position P1 (Step S16). Then, the developing roll 131 for the black becomes the state moved to the measurement position P3 of the toner concentration sensor 31. Hence, in this state, the toner concentration of the developing roll 131 for the black is measured (Step S17). After that, the operational flow returns to the step S11.

Also, at the step S14, if the page on which the next image is formed does not remain, similarly to the step S16, the rotary developing device 13 is rotated by the predetermined angle (=$\beta-\alpha$) in the R-direction from the state shown in FIG. 9B. Thus, as shown in FIG. 10, the home position HP of the rotary developing device 13 is moved to the development position P1 (Step S18). After that, the series of the image forming operations is completed. Additionally, at the step S18, when the home position HP of the rotary developing device 13 is moved to the development position P1, the toner concentration of the developing roll 131 for the black may be measured by the toner concentration sensor 31.

In this way, the image forming apparatus according to the second embodiment of the present invention employs the configuration where the home position HP of the rotary developing device 13 is set at the position that is separated at the same angle as the first angle $\alpha$ in the rotation direction R of the rotary developing device 13 from the developing roll 131 for the black, on the rotation orbit of the rotary developing device 13, in addition to the apparatus configuration of the first embodiment. Thus, when the home position HP of the rotary developing device 13 is returned to the development position P1, the toner concentration of the developing roll 131 for the black can be measured by the toner concentration sensor 31. Hence, in order to measure the toner concentration of the developing roll 131 for the black, it is not necessary to separately set the rotation stop position of the rotary developing device 13.

Also, each time the electrostatic latent image corresponding to one page is developed by the rotary developing device 13 during the image forming operation, the home position HP of the rotary developing device 13 is returned to the development position P1. Thus, every time, the toner concentration of the developing roll 131 for the black can be measured by the toner concentration sensor 31. For example, when the predetermined value J is set at J=1, the toner concentration for the black can be measured for each page. When it is set at J=10, the toner concentration for the black can be measured for each 10 pages. Hence, even if the image forming operation is carried out over a long period of time, the toner concentration for the developing roll 131 for the black can be measured periodically in the middle thereof, and the measured result can be reflected in the toner supplementing control for the black.

Third Embodiment

Figure 11A:
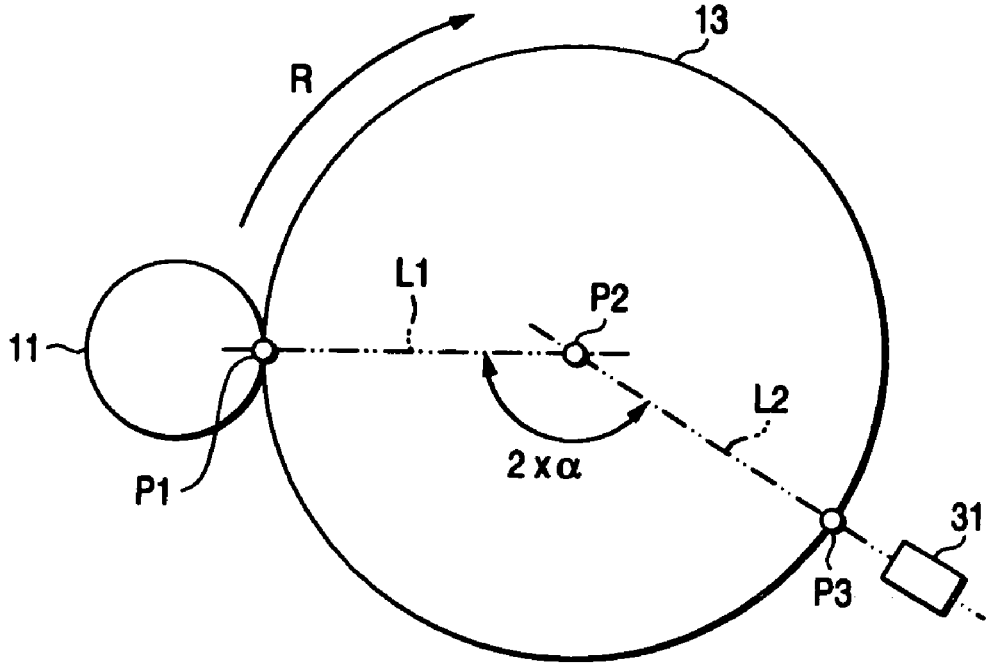
FIGS. 11A and 11B are schematic views showing a positional relationship between respective units around a rotary developing device according to a third embodiment of the present invention.
Figure 11B:
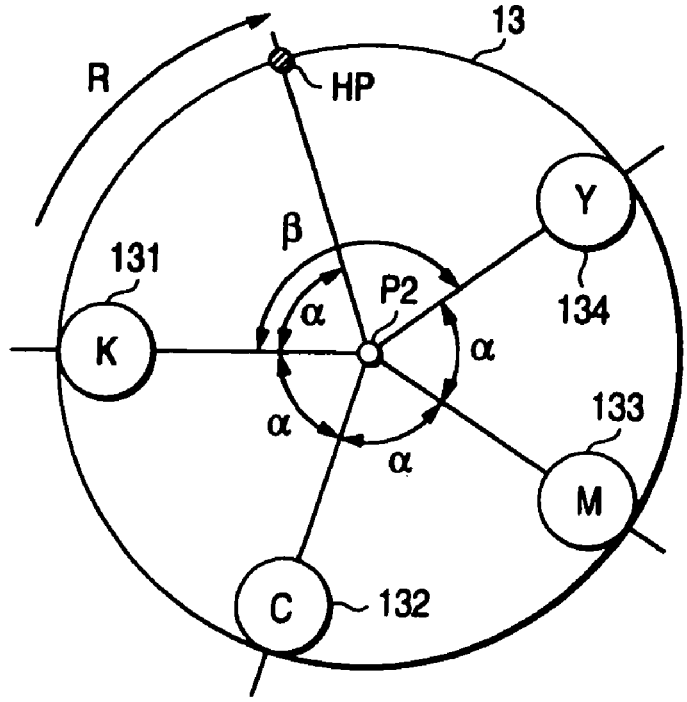

FIGS. 11A and 11B are schematic views showing the positional relationship between the respective units around the rotary developing device according to the third embodiment of the present invention. In this third embodiment, as compared with the second embodiment, on the rotation orbit of the rotary developing device 13, the arrangement relationship (angle allocation) between the development position P1, the home position HP and the developing rolls 131 to 134 is set under the same condition. However, on the rotation orbit of the rotary developing device 13, in the second embodiment, the measurement position P3 of the toner concentration sensor 31 is set at the position that is separated at the first angle α from the development position P1. However, this third embodiment is designed such that the measurement position P3 of the toner concentration sensor 31 is set at the position which is separated at the angle equal to two times the first angle α from the development position P1. With such a configuration, the second virtual straight line L2, which connects the rotation center P2 of the rotary developing device 13 and the measurement position P3 of the toner concentration sensor 31, becomes the straight line having the angle equal to two times the first angle α rotating oppositely in the rotation direction R of the rotary developing device 13, with respect to the first virtual straight line L1 which connects the development position P1 and the rotation center P2. Then, the measurement position P3 of the toner concentration sensor 31 is set on this second virtual straight line L2.

Figure 12:
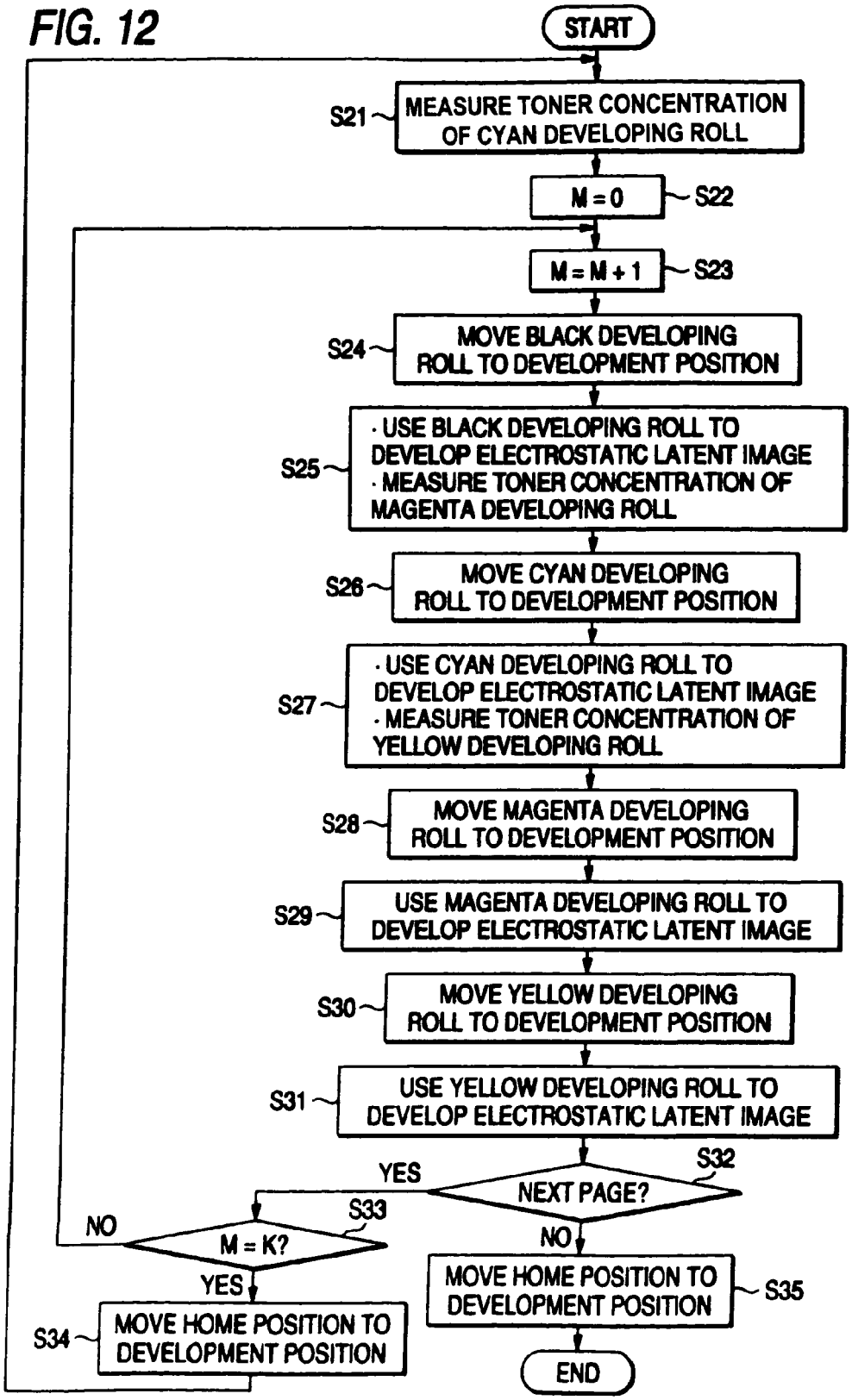
FIG. 12 is a flowchart showing a process procedure when the image forming apparatus according to the third embodiment of the present invention is used to form a full-color image.

FIG. 12 is the flowchart showing the process procedure when the image forming apparatus according to the third embodiment of the present invention is used to form the full-color image. This process procedure is carried out in accordance with the control process of the image formation controller (not shown).

Figure 13:
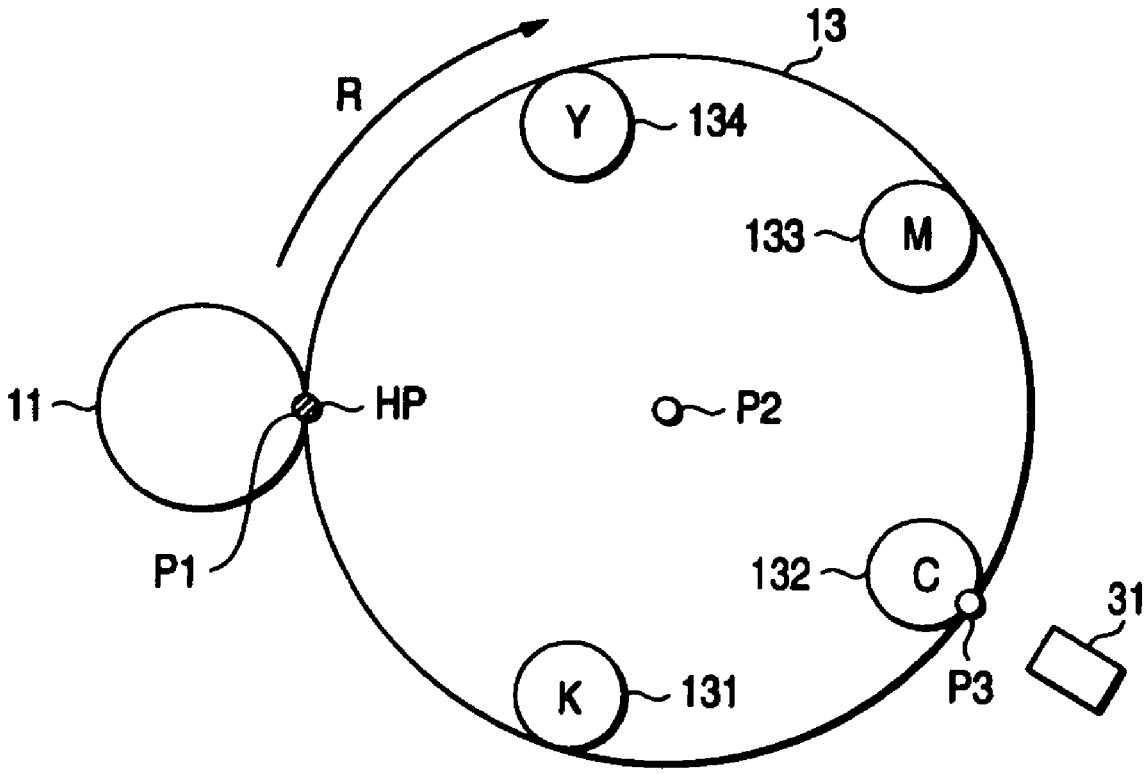
FIG. 13 is a view explaining an operation state of an image forming operation according to the third embodiment of the present invention (No. 1)

First, as shown in FIG. 13, in the state that the home position HP of the rotary developing device 13 is placed at the development position P1, the toner concentration of the developing roll 132 for the cyan is measured by the toner concentration sensor 31 (Step S21). Next, after the value of the variable M is reset to zero (Step S22), the M value is incremented by 1 (Step S23).

Figure 14A:
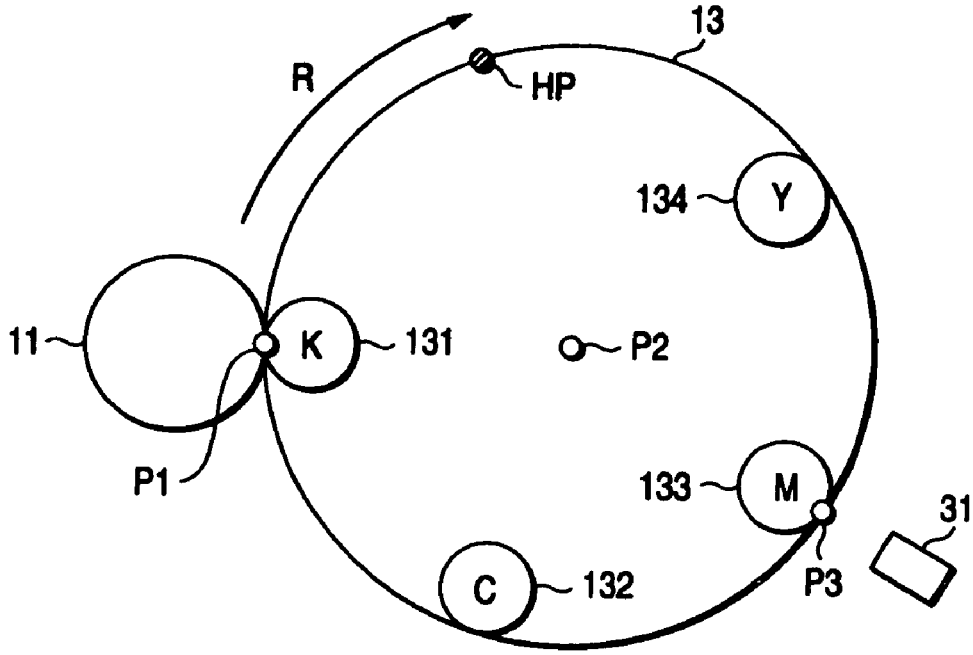
FIGS. 14A and 14B are views explaining an operation state of an image forming operation according to the third embodiment of the present invention (No. 2)

Subsequently, from the state shown in FIG. 13, the rotary developing device 13 is rotated by the first angle α in the R-direction. Thus, as shown in FIG. 14A, the developing roll 131 for the black is moved to the development position P1 (Step S24). Then, the developing roll 133 for the magenta becomes the state moved to the measurement position P3 of the toner concentration sensor 31. Hence, in this state, the developing roll 131 for the black is used to develop the electrostatic latent image on the photosensitive drum 11 into the toner image, and the toner concentration of the developing roll 133 for the magenta is measured by the toner concentration sensor 31 (Step S25).

Figure 14B:
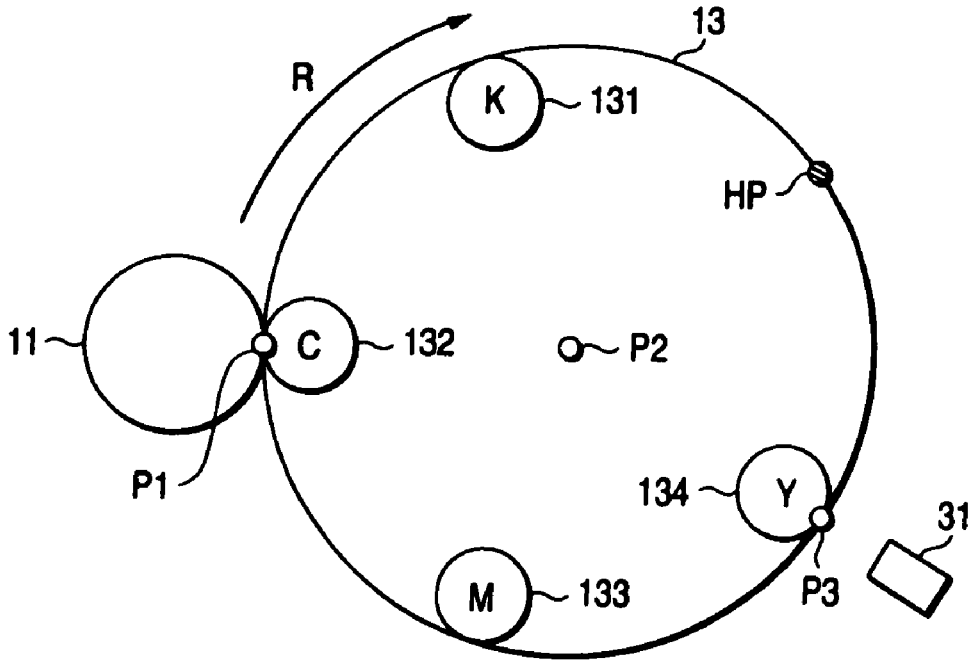

Next, from the state shown in FIG. 14A, the rotary developing device 13 is rotated by the first angle α in the R-direction. Thus, as shown in FIG. 14B, the developing roll 132 for the cyan is moved to the development position P1 (Step S26). Then, the developing roll 134 for the yellow becomes the state moved to the measurement position P3 of the toner concentration sensor 31. Hence, in this state, the developing roll 132 for the cyan is used to develop the electrostatic latent image on the photosensitive drum 11 into the toner image, and the toner concentration of the developing roll 134 for the yellow is measured by the toner concentration sensor 31 (Step S27).

Figure 15A:
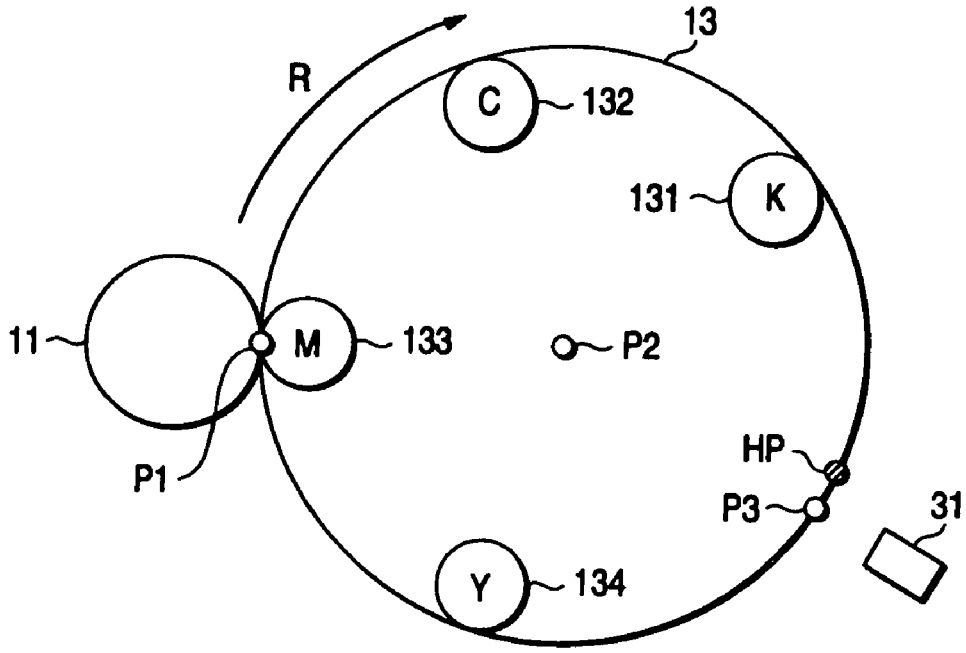
FIGS. 15A and 15B are views explaining an operation state of an image forming operation according to the third embodiment of the present invention (No. 3)

Next, from the state shown in FIG. 14B, the rotary developing device 13 is rotated by the first angle α in the R-direction. Thus, as shown in FIG. 15A, the developing roll 133 for the magenta is moved to the development position P1 (Step S28). Then, in this state, the developing roll 133 for the magenta is used to develop the electrostatic latent image on the photosensitive drum 11 into the toner image (Step S29).

Figure 15B:
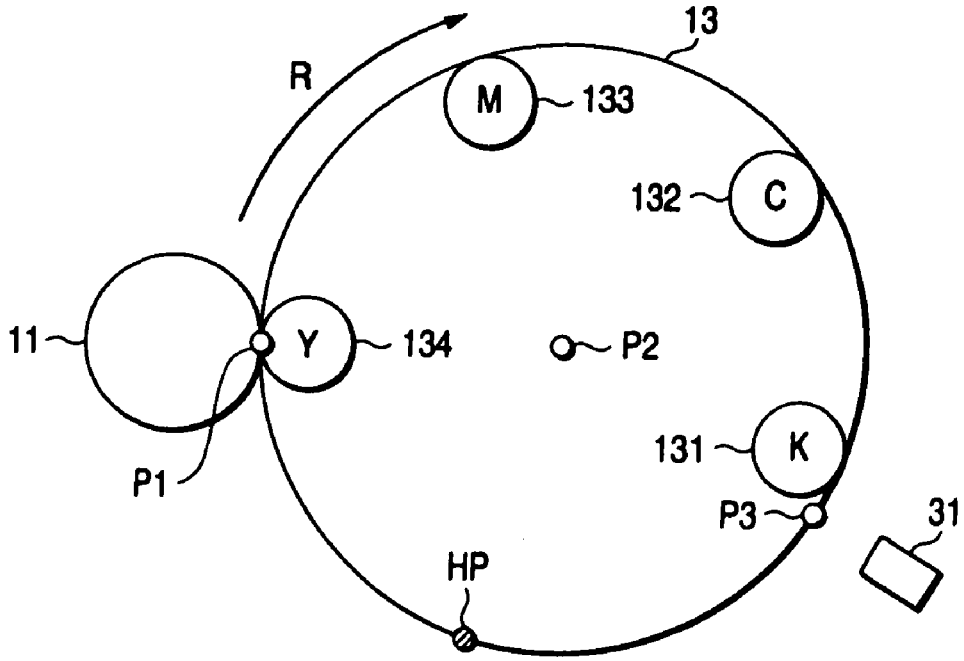

Next, from the state shown in FIG. 15A, the rotary developing device 13 is rotated by the first angle α in the R-direction. Thus, as shown in FIG. 15B, the developing roll 134 for the yellow is moved to the development position P1 (Step S30). Then, in this state, the developing roll 134 for the yellow is used to develop the electrostatic latent image on the photosensitive drum 11 into the toner image (Step S31).

As mentioned above, the operation cycle corresponding to one page related to the color image formation is ended. After that, whether or not a page on which a next image is formed remains is checked (Step S32). If the next page remains, whether or not a current M value reaches a preset predetermined value K is judged (Step S33). Then, if the M value does not reach the predetermined value K, the operational flow returns to the step S23. At that time, the rotation angle of the rotary developing device 13 required to move the developing roll 131 for the black to the development position P1 at the step S24 is set at the second angle β. The predetermined value K can be set at any value.

On the contrary, if the M value reaches (coincides with) the predetermined value K, the rotary developing device 13 is rotated by the predetermined angle (=β−α) in the R-direction from the state shown in FIG. 15B. Thus, again as shown in FIG. 13, the home position HP of the rotary developing device 13 is moved to the development position P1 (Step S34). Then, the developing roll 132 for the cyan becomes the state moved to the measurement position P3 of the toner concentration sensor 31. Hence, in this state, the operational flow returns to the process at the step S21.

Also, at the step S32, if the page on which the next image is formed does not remain, similarly to the step S34, the rotary developing device 13 is rotated by the predetermined angle (=β−α) in the R-direction from the state shown in FIG. 15B. Thus, as shown in FIG. 13, the home position HP of the rotary developing device 13 is moved to the development position P1 (Step S35). After that, the series of the image forming operations is completed.

In this way, in the image forming apparatus according to the third embodiment of the present invention, when with the rotation driving of the rotary developing device 13, the developing roll 131 for the black is moved to the development position P1, the developing roll 13 for the magenta is placed at the measurement position P3 of the toner concentration sensor 31, and when the developing roll 132 for the cyan is moved to the development position P1, the developing roll 134 for the yellow is placed at the measurement position P3 of the toner concentration sensor 31. Also, when the home position HP of the rotary developing device 13 is moved to the development position P1, the developing roll 132 for the cyan is placed at the measurement position P3 of the toner concentration sensor 31.

Thus, when the developing roll 131 for the black is used to develop the electrostatic latent image on the photosensitive drum 11, the toner concentration of the developing roll 133 for the magenta can be measured by the toner concentration sensor 31. When the developing roll 132 for the cyan is used to develop the electrostatic latent image on the photosensitive drum 11, the toner concentration of the developing roll 134 for the yellow can be measured by the toner concentration sensor 31. Also, when the home position HP of the rotary developing device 13 is returned to the development position P1, the toner concentration of the developing roll 132 for the cyan can be measured by the toner concentration sensor 31.

From the above-mentioned explanation, the toner concentrations of the developing rolls 132, 133 and 134 for the colors (cyan, magenta and yellow) can all be measured by the toner concentration sensor 31, when the developing rolls for the other colors are used to develop the electrostatic latent image or when the home position HP of the rotary developing device 13 is returned to the development position P1. Thus, at the time of the formation of the full-color image, except for when the respective developing rolls 131 to 134 are stopped at the development position P1 for the image formation or when the home position HP of the rotary developing device 13 is returned to the development position P1, it is not necessary to stop the rotation of the rotary developing device 13 for the purpose of measuring the toner concentration of the developing roll. In addition, during the image forming operation, the angle reference data required to control the rotation angle of the rotary developing device 13 can be made to respond to the two angles α and β. For this reason, the rotation drive control of the rotary developing device 13 is made very simple. Also, the number of times that the rotation of the rotary developing device is stopped during the image forming operation can be reduced to the minimum necessary number. Hence, high productivity can be achieved.

Moreover, in this third embodiment, the angular interval between the development position P1 and the measurement position P3 is set at the angle equal to two times the first angle α. Thus, the toner concentration sensor 31 can be placed at the position that is separated laterally from the development position P1. Thus, it is possible to effectively avoid the toner dropping from the development position P1 from being deposited on the toner concentration sensor 31. Also, when the angular interval between the development position P1 and the measurement position P3 on the rotation orbit of the rotary developing device 13 is set at the first angle α, the installation position of the toner concentration sensor 31 is interiorly located in the entire image forming apparatus (on the depth side from an operator). Thus, this easily brings about troubles that it is difficult to reserve the installation space for the toner concentration sensor 31 and that the maintenance work (the replacement or the like) of the toner concentration sensor 31 becomes troublesome. On the contrary, when the angular interval between the development position P1 and the measurement position P3 on the rotation orbit of the rotary developing device 13 is set to be two times the first angle α, the installation position of the toner concentration sensor 31 is exteriorly located in the entire image forming apparatus (on the front side from the operator). Hence, it is easy to reserve the installation space for the toner concentration sensor 31 and also possible to easily execute the maintenance work of the toner concentration sensor 31.

Fourth Embodiment

Figure 16A:
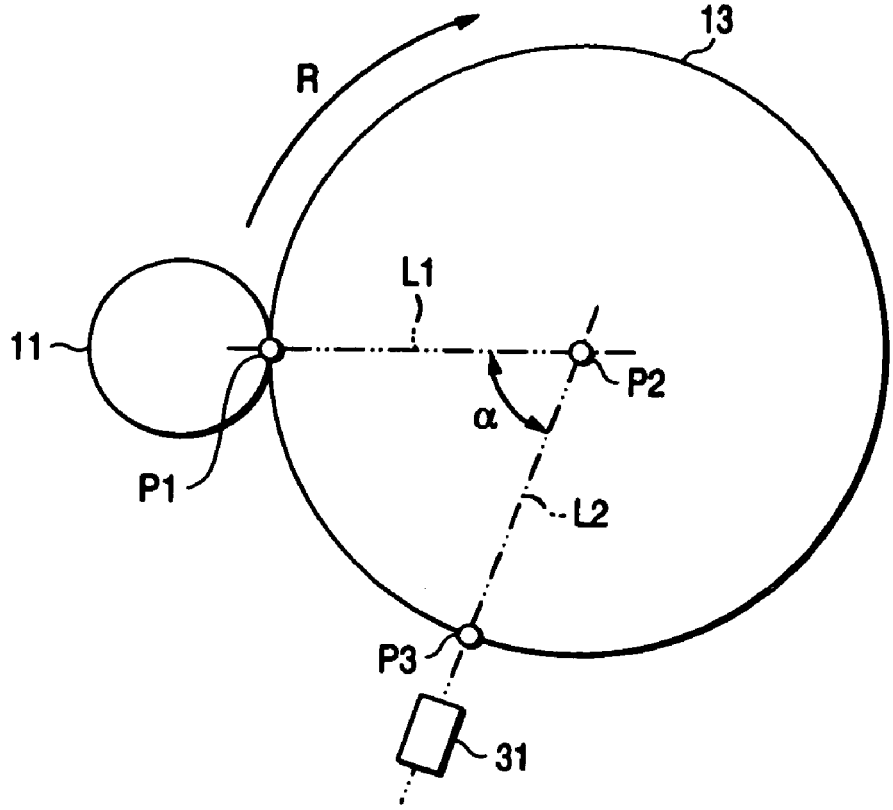
FIGS. 16A and 16B is a schematic view showing a positional relationship between respective units around a rotary developing device according to a fourth embodiment of the present invention.
Figure 16B:
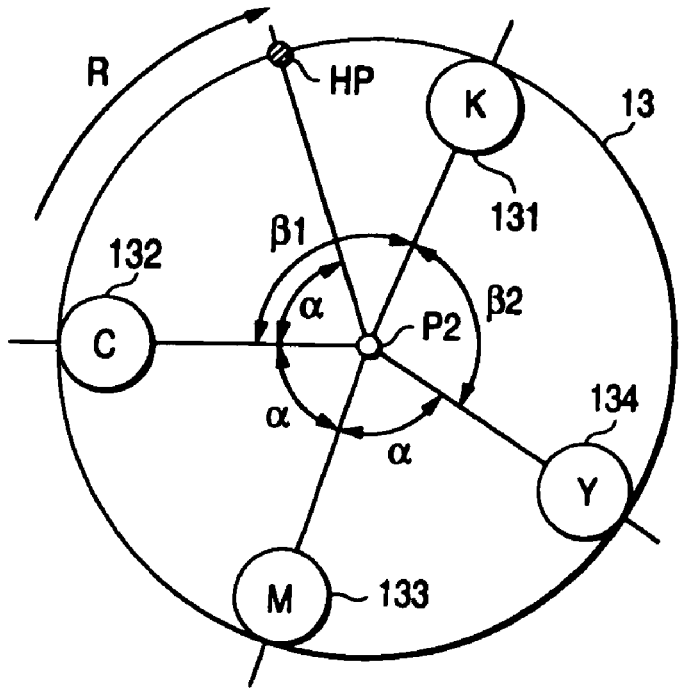

FIGS. 16A and 16B are schematic views showing the positional relationship between the respective units around the rotary developing device according to the fourth embodiment of the present invention. In this fourth embodiment, especially as compared with the second embodiment, the arrangement relationship between the development position P1 and the measurement position P3 (the angle between the virtual straight lines L1 and L2) on the rotation orbit of the rotary developing device 13 is set under the same condition (the first angle α). However, in this fourth embodiment, the development color order when the color image is formed is set in the order of cyan→magenta→yellow→black. In accordance with this order, the developing roll 132 for the cyan, the developing roll 133 for the magenta, the developing roll 134 for the yellow and the developing roll 131 for the black are placed in turn rotating oppositely in the rotation direction R of the rotary developing device 13.

Also, on the rotation orbit of the rotary developing device 13, the angular interval between the developing roll 132 for the cyan and the developing roll 133 for the magenta is set at the same angle as the first angle α, and the angular interval between the developing roll 133 for the magenta and the developing roll 134 for the yellow is also set at the same angle as the first angle α. On the contrary, the angular interval between the developing roll 131 for the black and the developing roll 132 for the cyan is set at an angle β1 that is greater than the first angle α, and the angular interval between the developing roll 134 for the yellow and the developing roll 131 for the black is set at any angle β2. The angle β2 may be greater or smaller than the first angle α.

Also, the home position HP of the rotary developing device 13 is set between the developing roll 132 for the cyan and the developing roll 131 for the black. This home position HP is set at the position that is shifted by the first angle α in the rotation direction R of the rotary developing device 13 from the developing roll 132 for the cyan, on the rotation orbit of the rotary developing device 13. Thus, the angular interval between the home position HP and the developing roll 132 for the cyan is also set at the same angle as the first angle α.

Since the respective developing rolls 131 to 134 are placed on the rotation orbit of the rotary developing device 13 in the foregoing angle allocation, the space greater than that between the other developing rolls is reserved between the developing roll 131 for the black and the developing roll 132 for the cyan around the rotation axis of the rotary developing device 13. Thus, for example, when the capacity of the toner cartridge for the black is desired to be larger than those of the toner cartridges for the other colors (cyan, magenta and yellow), this can be resolved setting the installation position of the toner cartridge for the black, not only between the developing roll 131 for the black and the developing roll 134 for the yellow in the previous embodiments, but also in the space from the developing roll 132 for the cyan, around the rotation axis of the rotary developing device 13. Thus, the degree of freedom of design is increased.

Also, space whose dimensions are different from those between the other developing rolls on the basis of the angle β2 is reserved between the developing roll 131 for the black and the developing roll 134 for the yellow around the rotation axis of the rotary developing device 13. Thus, for example, when the capacity of the toner cartridge for the yellow is desired to be smaller than those of the toner cartridges for the cyan and the magenta, it can be resolved by setting the angular allocation under the condition of α>β2 and setting the installation position of the toner cartridge for the yellow in the space between the developing roll 131 for the black and the developing roll 132 for the cyan, around the rotation axis of the rotary developing device 13.

Figure 17:
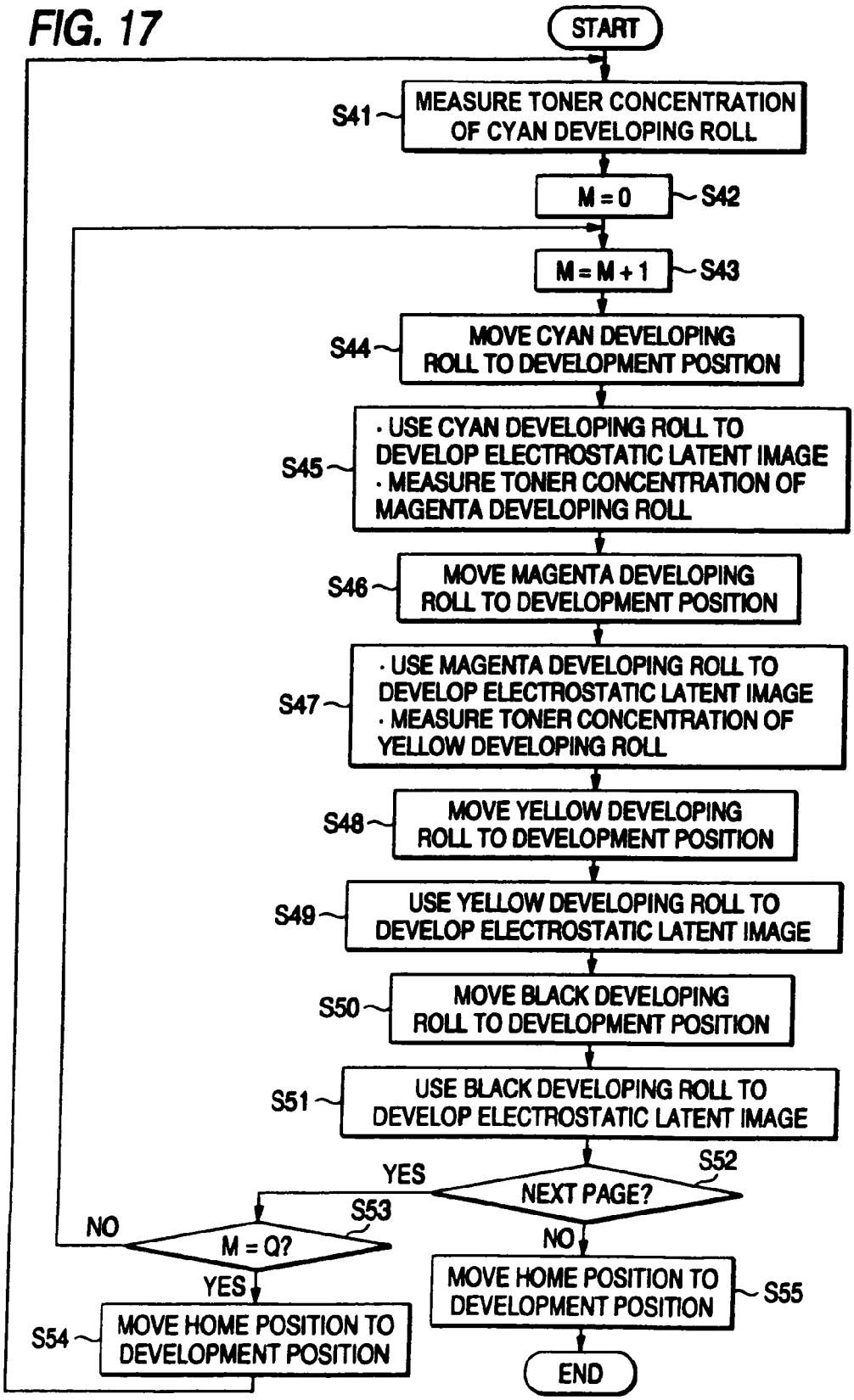
FIG. 17 is a flowchart showing a process procedure when the image forming apparatus according to the fourth embodiment of the present invention is used to form a full-color image.

FIG. 17 is a flowchart showing the process procedure when the image forming apparatus according to the fourth embodiment of the present invention is used to form the full-color image. This process procedure is carried out in accordance with the control process of the image formation controller (not shown).

Figure 18:
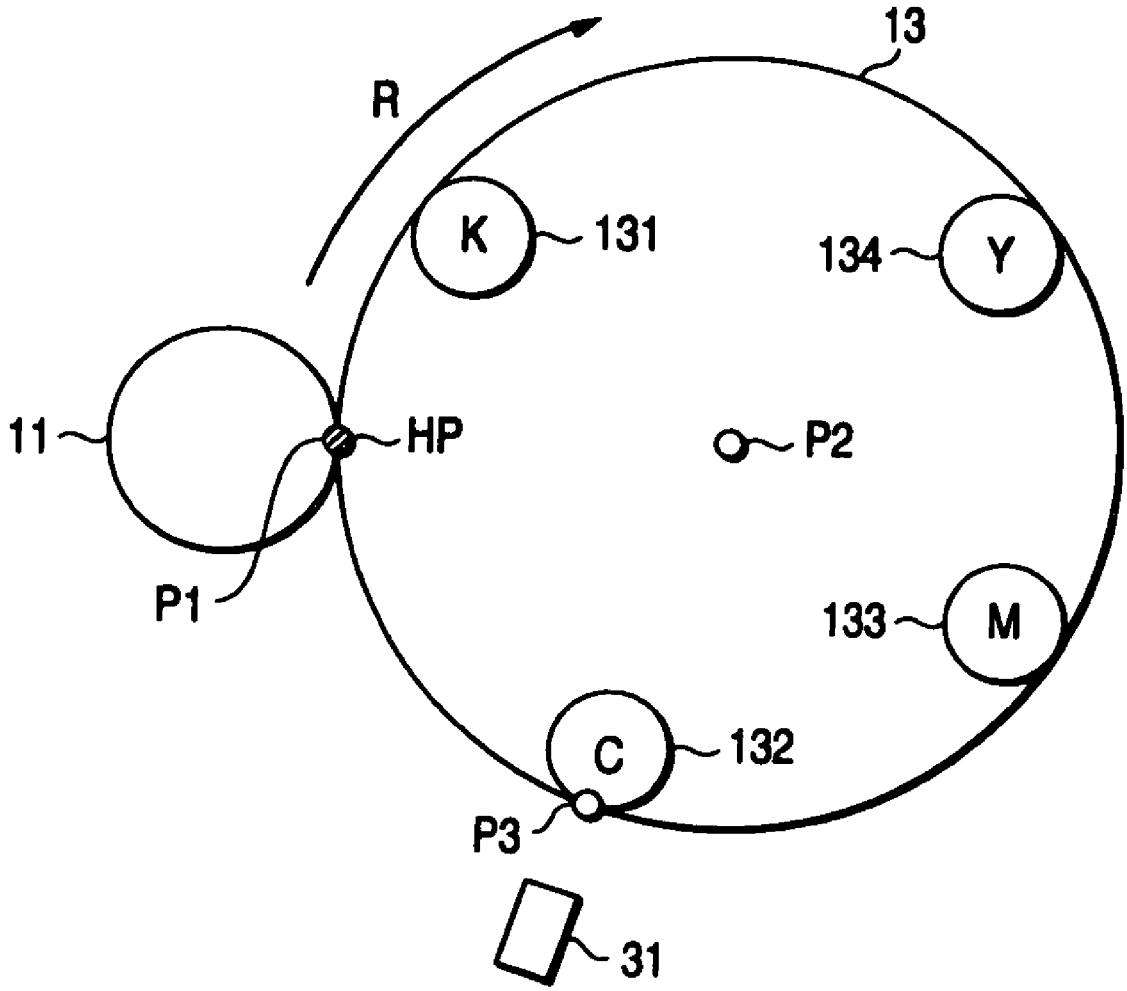
FIG. 18 is a view explaining an operation state of an image forming operation according to the fourth embodiment of the present invention (No. 1)

First, as shown in FIG. 18, in the state that the home position HP of the rotary developing device 13 is placed at the development position P1, the toner concentration of the developing roll 132 for the cyan is measured by the toner concentration sensor 31 (Step S41). Next, after the value of the variable M is reset to zero (Step S42), the M value is incremented by 1 (Step S43).

Figure 19A:
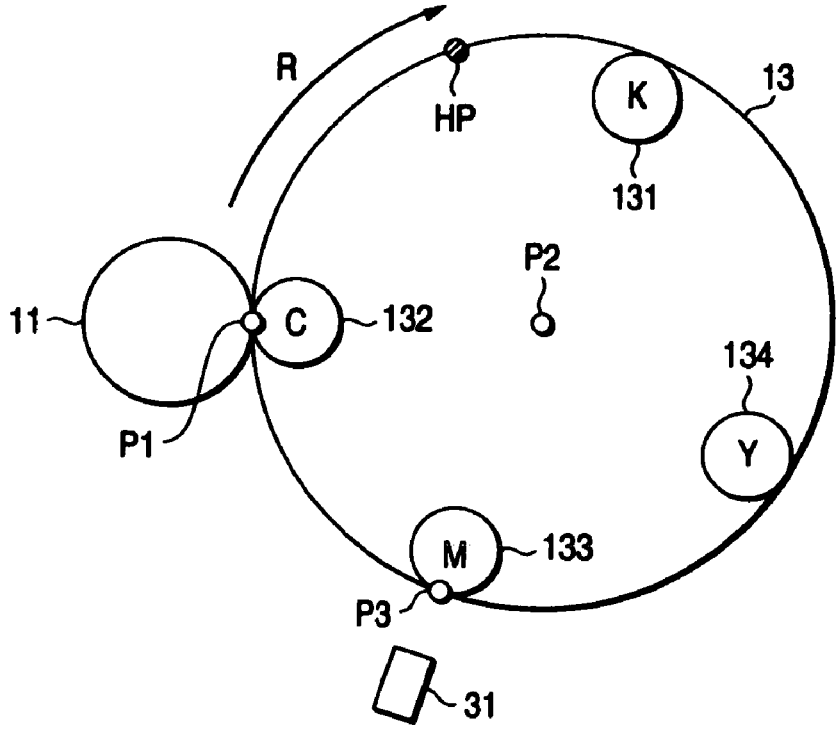
FIGS. 19A and 19B are views explaining an operation state of an image forming operation according to the fourth embodiment of the present invention (No. 2)

Subsequently, from the state shown in FIG. 18, the rotary developing device 13 is rotated by the first angle α in the R-direction. Thus, as shown in FIG. 19A, the developing roll 132 for the cyan is moved to the development position P1 (Step S44). Then, the developing roll 133 for the magenta becomes the state moved to the measurement position P3 of the toner concentration sensor 31. Hence, in this state, the developing roll 132 for the cyan is used to develop the electrostatic latent image on the photosensitive drum 11 into the toner image, and the toner concentration of the developing roll 133 for the magenta is measured by the toner concentration sensor 31 (Step S45).

Figure 19B:
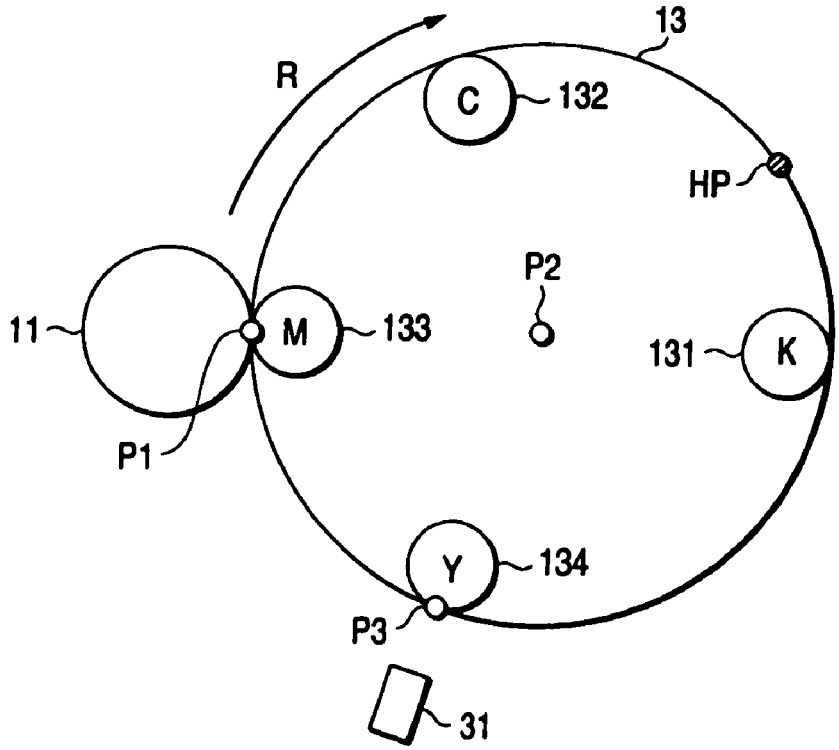

Next, from the state shown in FIG. 19A, the rotary developing device 13 is rotated by the first angle α in the R-direction. Thus, as shown in FIG. 19B, the developing roll 133 for the magenta is moved to the development position P1 (Step S46). Then, the developing roll 134 for the yellow becomes the state moved to the measurement position P3 of the toner concentration sensor 31. Hence, in this state, the developing roll 133 for the magenta is used to develop the electrostatic latent image on the photosensitive drum 11 into the toner image, and the toner concentration of the developing roll 134 for the yellow is measured by the toner concentration sensor 31 (Step S47).

Figure 20A:
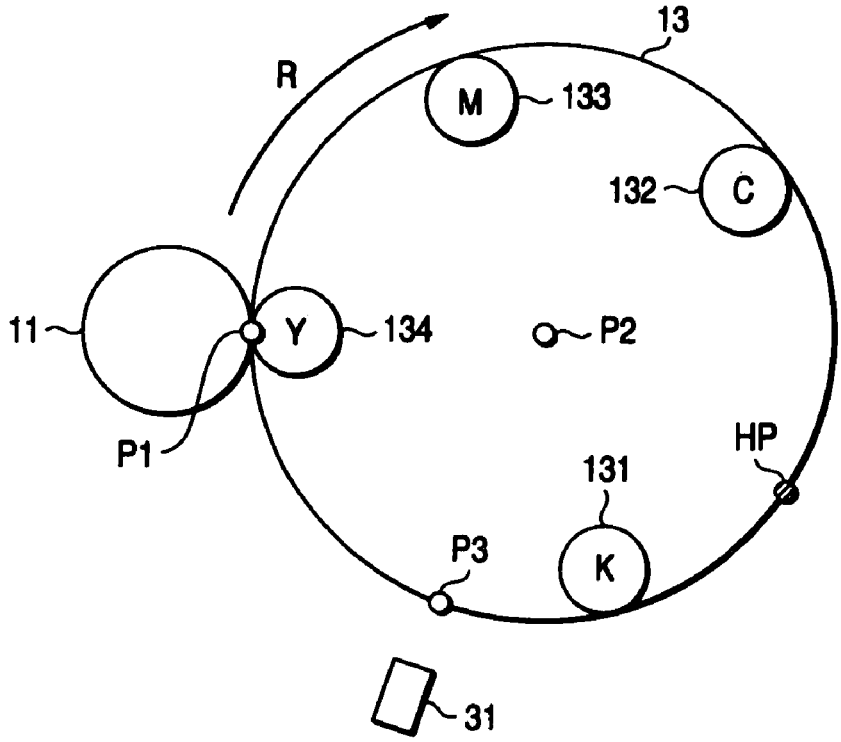
FIGS. 20A and 20B are views explaining an operation state of an image forming operation according to the fourth embodiment of the present invention (No. 3).

Next, from the state shown in FIG. 19B, the rotary developing device 13 is rotated by the first angle α in the R-direction. Thus, as shown in FIG. 20A, the developing roll 134 for the yellow is moved to the development position P1 (Step S48). Then, in this state, the developing roll 134 for the yellow is used to develop the electrostatic latent image on the photosensitive drum 11 into the toner image (Step S49).

Figure 20B:
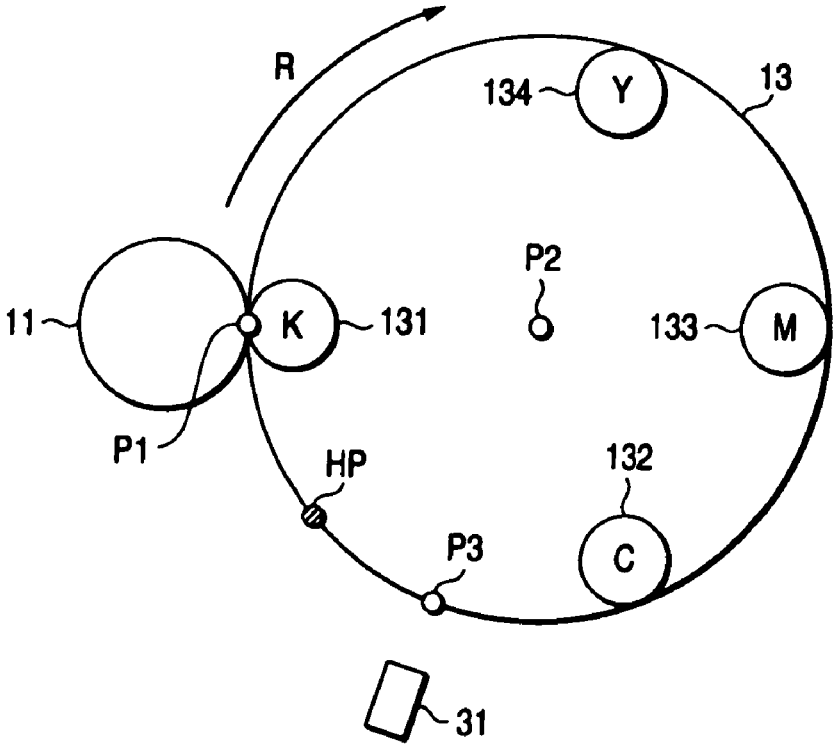

Next, from the state shown in FIG. 20A, the rotary developing device 13 is rotated by the angle β2 in the R-direction. Thus, as shown in FIG. 20B, the developing roll 131 for the black is moved to the development position P1 (Step S50). Then, in this state, the developing roll 131 for the black is used to develop the electrostatic latent image on the photosensitive drum 11 into the toner image (Step S51).

As mentioned above, the operation cycle corresponding to one page related to the color image formation is ended. After that, whether or not a page on which a next image is formed remains is checked (Step S52). If the next page remains, whether or not a current M value reaches a preset predetermined value Q is judged (Step S53). Then, if the M value does not reach the predetermined value Q, the operational flow returns to the step S43. At that time, the rotation angle of the rotary developing device 13 required to move the developing roll 132 for the cyan to the development position P1 at the step S44 is set at the angle β1. The predetermined value Q can be set at any value.

On the contrary, if the M value reaches (coincides with) the predetermined value Q, the rotary developing device 13 is rotated by a predetermined angle (=β1−α) in the R-direction from the state shown in FIG. 20B. Thus, again as shown in FIG. 18, the home position HP of the rotary developing device 13 is moved to the development position P1 (Step S54). Then, the developing roll 132 for the cyan becomes the state moved to the measurement position P3 of the toner concentration sensor 31. Thus, in this state, the operational flow returns to the process at the step S41.

Also, at the step S52, if the page on which the next image is formed does not remain, similarly to the step S54, the rotary developing device 13 is rotated by the predetermined angle (=β1−α) in the R-direction from the state shown in FIG. 20B. Thus, as shown in FIG. 18, the home position HP of the rotary developing device 13 is moved to the development position P1 (Step S55). After that, the series of the image forming operations is completed.

In this way, in the image forming apparatus according to the fourth embodiment of the present invention, when with the rotation driving of the rotary developing device 13, the developing roll 132 for the cyan is moved to the development position P1, the developing roll 133 for the magenta is placed at the measurement position P3 of the toner concentration sensor 31, and when the developing roll 133 for the magenta is moved to the development position P1, the developing roll 134 for the yellow is placed at the measurement position P3 of the toner concentration sensor 31. Also, when the home position HP of the rotary developing device 13 is moved to the development position P1, the developing roll 132 for the cyan is placed at the measurement position P3 of the toner concentration sensor 31.

Thus, when the developing roll 132 for the cyan is used to develop the electrostatic latent image on the photosensitive drum 11, the toner concentration of the developing roll 133 for the magenta can be measured by the toner concentration sensor 31, and when the developing roll 133 for the magenta is used to develop the electrostatic latent image on the photosensitive drum 11, the toner concentration of the developing roll 134 for the yellow can be measured by the toner concentration sensor 31. Also, when the home position HP of the rotary developing device 13 is returned to the development position P1, the toner concentration of the developing roll 132 for the cyan can be measured by the toner concentration sensor 31.

From the above-mentioned explanation, the toner concentrations of the developing rolls 132, 133 and 134 for the colors (cyan, magenta and yellow) can all be measured by the toner concentration sensor 31, when the developing rolls for the other colors are used to develop the electrostatic latent image or when the home position HP of the rotary developing device 13 is returned to the development position P1. Thus, in the case of forming the full-color image, except for when the respective developing rolls 131 to 134 are stopped at the development position P1 for the image formation or when the home position HP of the rotary developing device 13 is returned to the development position P1, it is not necessary to stop the rotation of the rotary developing device 13 for the purpose of measuring the toner concentration of the developing roll. In addition, during the image forming operation, the angle reference data required to control the rotation angle of the rotary developing device 13 can be made to respond the three angles α, β1 and β2. For this reason, the rotation drive control of the rotary developing device 13 is made very simple. Also, the number of times when the rotation of the rotary developing device is stopped during the image forming operation can be reduced to the minimum necessary number. Hence, the high productivity can be achieved.

Furthermore, in the above-mentioned respective embodiments, as the configuration of the rotary developing device 13, the configuration having the four developing rolls 131 to 134 corresponding to the respective colors of black, cyan, magenta and yellow has been exemplified. However, the present invention is not limited thereto. Other than the four developing rolls, the configuration having the developing roll for special colors, for example, such as silver, gold and the like may be used.

Fifth Embodiment

Figure 21A:
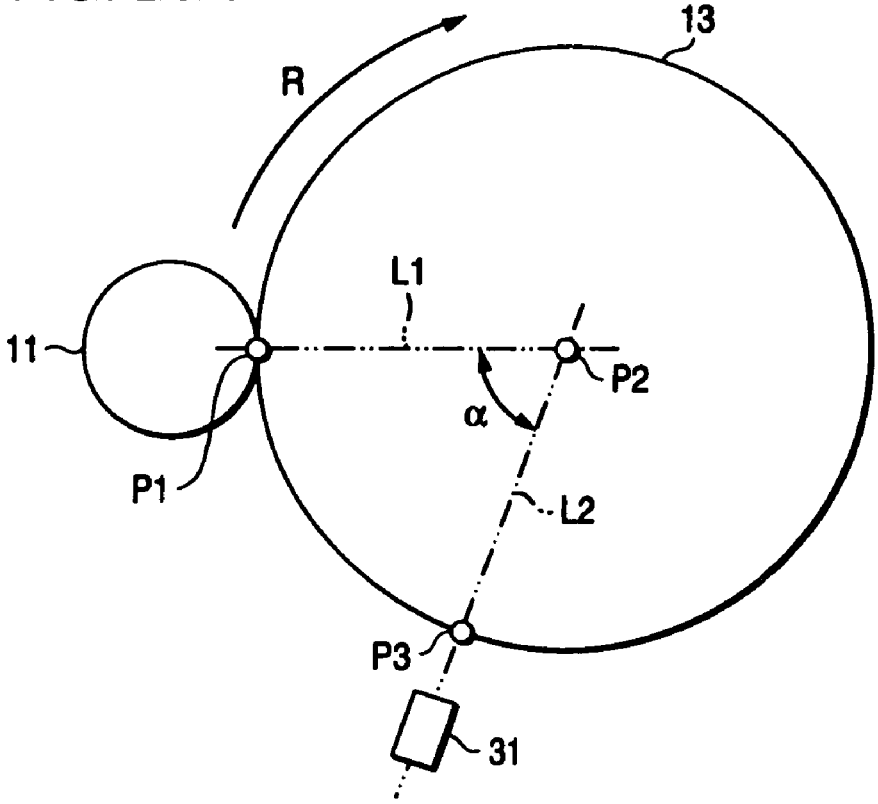
FIGS. 21A and 21B are schematic views showing a positional relationship between respective units around a rotary developing device according to an embodiment of the present invention.
Figure 21B:
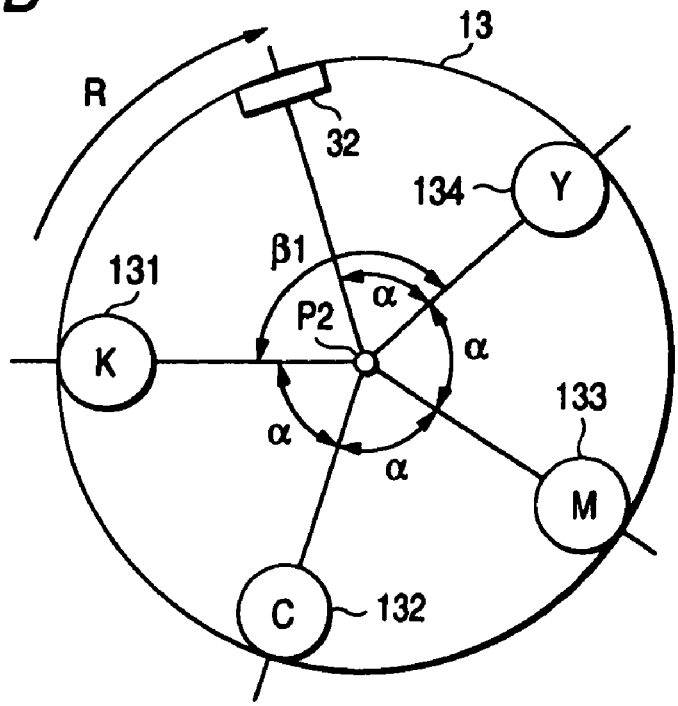

FIGS. 21A and 21B are schematic views showing the positional relationship between the respective units around the rotary developing device according to the first embodiment of the present invention. As shown in the figures, the rotary developing device 13 is placed in the state close to the photosensitive drum 11, at a development position P1 opposite the photosensitive drum 11. The development position P1 implies the position where the process for developing the electrostatic latent image formed on the photosensitive drum 11 into the toner image is actually executed.

Around (near) the rotary developing device 13, a toner concentration sensor 31 is placed opposite to the outer circumference of the rotary developing device 13. The toner concentration sensor 31 measures the toner concentration (toner mixture ratio) of the two-component developer held in each of the developing rolls 131, 132, 133 and 134. As the toner concentration sensor 31, it is possible to use an optical sensor, for example, in which a light emitting device and a light receiving device are combined. When the optical sensor is used, the reflection light from the developer held in the developing roll is received, thereby enabling the toner concentration to be measured at an optical reflectance of the developer.

Here, around the rotation axis of the rotary developing device 13, a rotation center P2 of the rotary developing device 13 and the development position P1 opposite the photosensitive drum 11 are connected by a first virtual straight line L1. Then, with the rotation center P2 from this first virtual straight line L1 as a standard, a second virtual straight line L2 is laid at a first angle $\alpha$, opposite to a rotation direction R of the rotary developing device 13, namely, counterclockwise (on the upstream side of the rotation direction R). As a result, a measurement position P3 of the toner concentration sensor 31 is set on the second virtual straight line L2. The measurement position P3 of the toner concentration sensor 31 implies the target position when the toner concentration is measured by the toner concentration sensor 31. For example, when the toner concentration sensor 31 is the optical sensor, in order to measure the optical reflectance, the position to which the light is emitted by the light emitting device of the toner concentration sensor 31 corresponds to the measurement position P3. In short, the foregoing first virtual straight line L1 and second virtual straight line L2 intersect each other at the rotation center P2. Also, the first angle $\alpha$ between the first virtual straight line L1 and the second virtual straight line L2 is set in the range of $0<\alpha<90°$.

On the contrary, the four developing rolls 131 to 134 are placed in turn at the same angular interval as the first angle a rotating oppositely in the rotation direction R of the rotary developing device 13 (counterclockwise) with the position of the developing roll 131 for the black as the standard (start point), on the rotation orbit of the rotary developing device 13. That is, with the rotation center P2 of the rotary developing device 13 as the standard, on the rotation orbit of the rotary developing device 13, the position of each of the developing rolls 131 to 134 is defined at the angle around the rotation axis. Then, with regard to the position of the developing roll 131 for the black, the developing roll 132 for the cyan is counterclockwise placed at the position at the first angle $\alpha$. Also, with regard to the position of the developing roll 132 for the cyan, the developing roll 133 for the magenta is counterclockwise placed at the position at the first angle $\alpha$. With regard to the position of the developing roll 133 for the magenta, the developing roll 134 for the yellow is counterclockwise placed at the position at the first angle $\alpha$. And, with regard to the position of the developing roll 134 for the yellow, the developing roll 131 for the black is counterclockwise placed at the position at a second angle $\beta$ that is greater than the first angle $\alpha$. In this case, the second angle $\beta$ is set in the range of $90°<\beta<180°$.

In this embodiment, as the especially preferable example, a predetermined angle $\alpha$ is set to $\alpha=360°\div5$, namely, $\alpha=72°$. A value where 1 is added to the number of the developing rolls (N=4) included by the rotary developing device 13 is applied to a divisor to define the predetermined angle $\alpha$. In this case, the angle $\beta$ becomes $\beta=144°$ because it is set by $\beta=2\times\alpha$.

In accordance with the foregoing angle allocation, the respective developing rolls 131 to 134 are placed on the rotation orbit of the rotary developing device 13. Thus, around the rotation axis of the rotary developing device 13, the space larger than that between the other developing rolls is reserved between the developing roll 131 for the black and the developing roll 134 for the yellow. Hence, for example, when the capacity of the toner cartridge for the black is desired to be larger than those of the toner cartridges for the other colors (cyan, magenta and yellow), this can be resolved by setting the installation position of the toner cartridge for the black in the space between the developing roll 131 for the black and the developing roll 134 for the yellow, around the rotation axis of the rotary developing device 13.

Also, on the rotation orbit of the rotary developing device 13, a concentration standard member 32 is placed between the developing roll 131 for the black and the developing roll 134 for the yellow. The concentration standard member 32 is placed at a position that is separated at the same angle as the predetermined angle $\alpha$ rotating oppositely in the rotation direction R of the rotary developing device 13, namely, counterclockwise, with respect to a position of the developing roll 134 for the yellow. The concentration standard member 32 is used in order to calibrate the toner concentration sensor 31. The concentration standard member 32 is constituted by colorant, such as ceramics having a reflectance corresponding to a predetermined toner concentration, resin and the like, when the measurement surface of the concentration standard member 32 is assumed to serve as the developing roll and measured by the toner concentration sensor 31. As a specifically calibrating method of the toner concentration sensor 31 that uses this concentration standard member 32, it is possible to employ a method of adjusting a sensor output (sensitivity) so that a measurement value when the concentration of the measurement surface of the concentration standard member 32 is measured by the toner concentration sensor 31 coincides with a preset standard value.

Figure 22A:
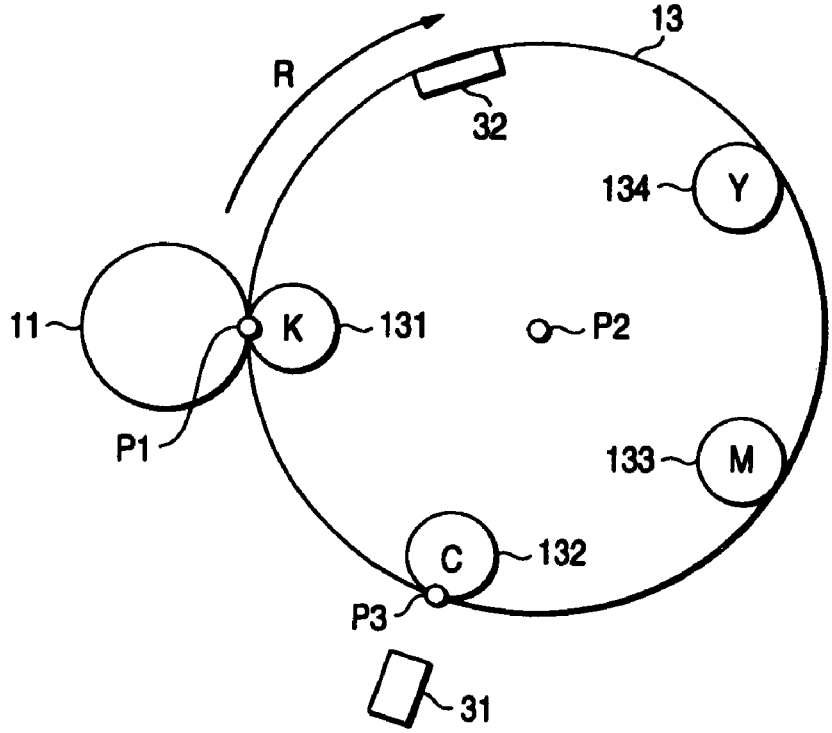
FIGS. 22A and 22B are views showing a rotation operation example of the rotary developing device (No. 4)
Figure 22B:
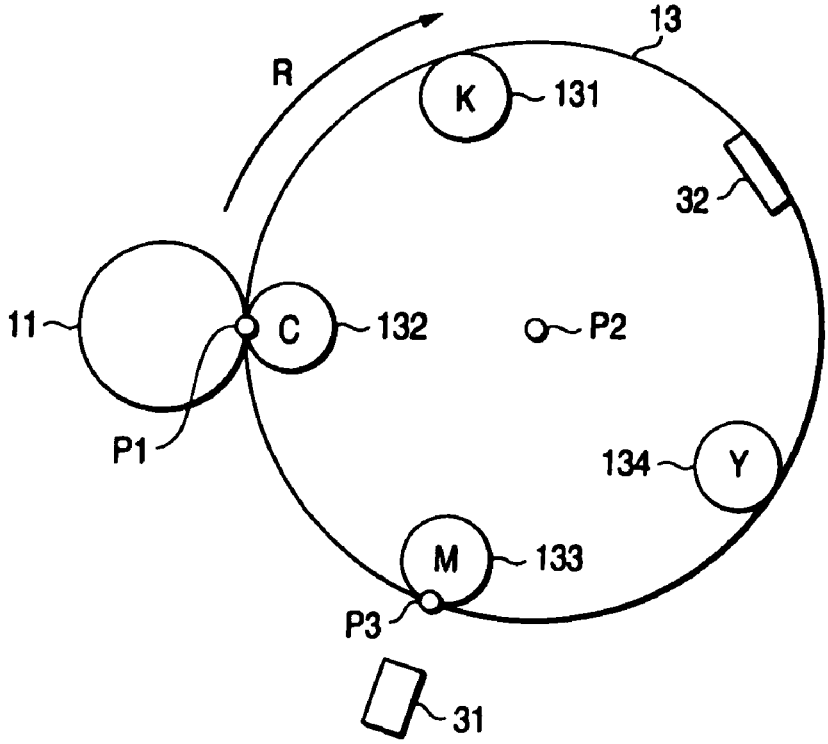
Figure 23A:
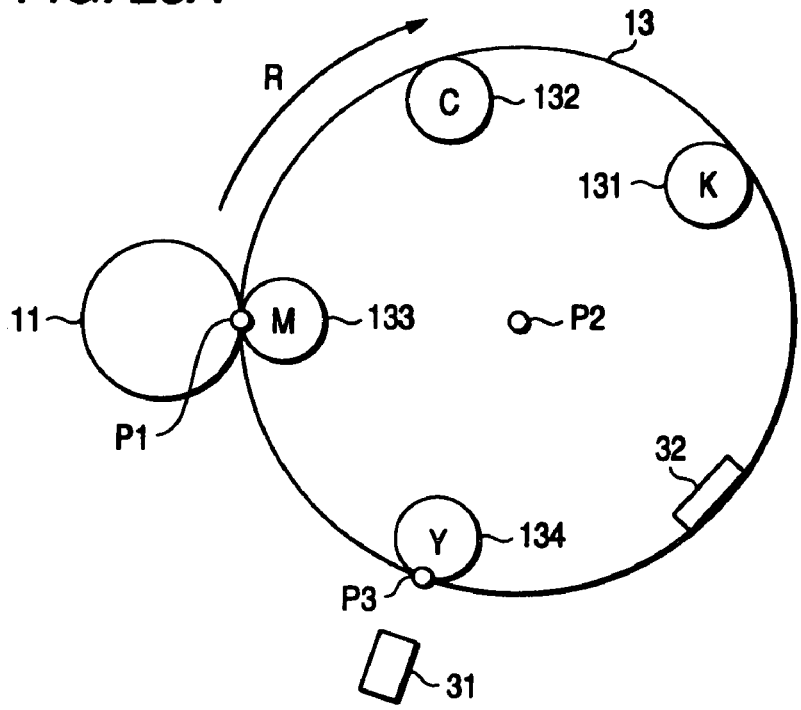
FIGS. 23A and 23B are views showing a rotation operation example of the rotary developing device (No. 5)
Figure 23B:
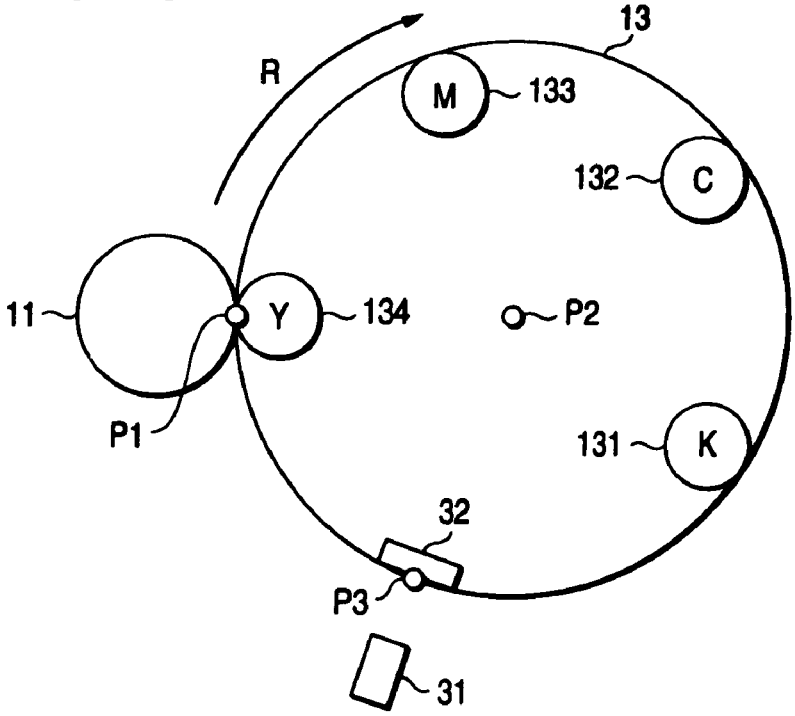

In the image forming apparatus having the foregoing configuration, when the rotation driving motor is driven, the rotary developing device 13 is rotated in the R-direction. At this time, as shown in FIG. 22A, when the developing roll 131 for the black is moved to the development position P1, the developing roll 132 for the cyan becomes the state moved to the measurement position P3 of the toner concentration sensor 31. As shown in FIG. 22B, when the developing roll 132 for the cyan is moved to the development position P1, the developing roll 133 for the magenta becomes the state moved to the measurement position P3 of the toner concentration sensor 31. Also, as shown in FIG. 23A, when the developing roll 133 for the magenta is moved to the development position P1, the developing roll 134 for the yellow becomes the state moved to the measurement position P3 of the toner concentration sensor 31. And, as shown in FIG. 23B, when the developing roll 134 for the yellow is moved to the development position P1, the concentration standard member 32 becomes the state moved to the measurement position P3 of the toner concentration sensor 31.

Figure 24:
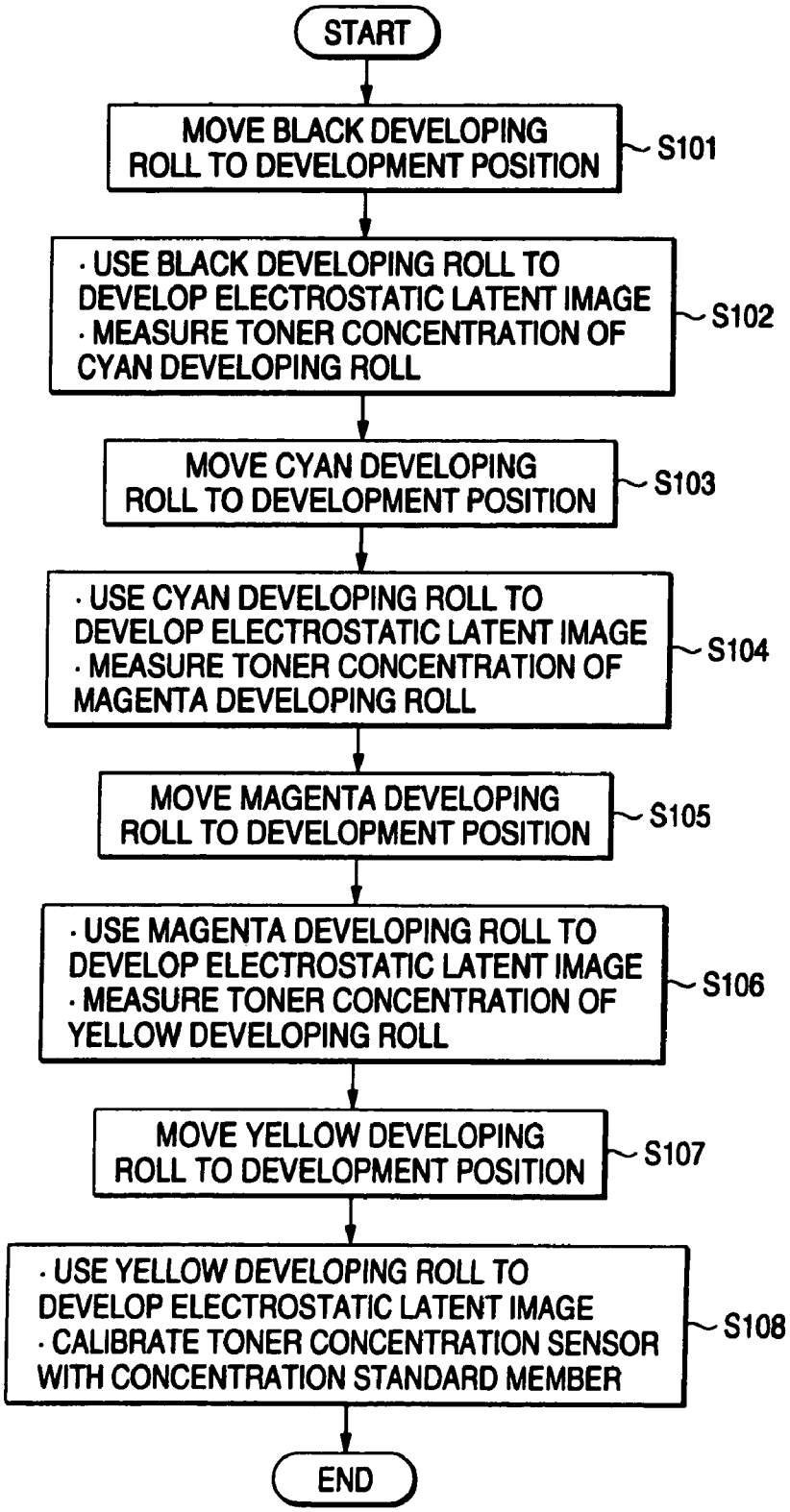
FIG. 24 is a flowchart showing an operation procedure when a color image is formed.

FIG. 24 is a flowchart showing the operation procedure when the image forming apparatus according to the embodiment of the present invention is used to form the full-color image.

At first, as shown in FIG. 22A, the developing roll 131 for the black is moved to the development position P1 (Step S101). In this state, the developing roll 131 for the black is used to develop the electrostatic latent image on the photosensitive drum 11 into the toner image, and the toner concentration of the developing roll 132 for the cyan is measured by the toner concentration sensor 31 (Step S102).

Next, as shown in FIG. 22B, the developing roll 132 for the cyan is moved to the development position P1 (Step S103). Then, in this state, the developing roll 132 for the cyan is used to develop the electrostatic latent image on the photosensitive drum 11 into the toner image, and the toner concentration of the developing roll 133 for the magenta is measured by the toner concentration sensor 31 (Step S104).

Next, as shown in FIG. 23A, the developing roll 133 for the magenta is moved to the development position P1 (Step S105). Then, in this state, the developing roll 133 for the magenta is used to develop the electrostatic latent image on the photosensitive drum 11 into the toner image, and the toner concentration of the developing roll 134 for the yellow is measured by the toner concentration sensor 31 (Step S106).

Next, as shown in FIG. 23B, the developing roll 134 for the yellow is moved to the development position P1 (Step S107). In this state, the developing roll 134 for the yellow is used to develop the electrostatic latent image on the photosensitive drum 11 into the toner image, and the concentration standard member 32 is used to calibrate the toner concentration sensor 31 (Step S108). As mentioned above, one operation cycle corresponding to the color image formation is completed.

In this way, in the image forming apparatus according to the embodiment of the present invention, when the developing roll 131 for the black is moved to the development position P1 to carry out the development, the developing roll 132 for the cyan can be measured by the toner concentration sensor 31. When the developing roll 132 for the cyan is moved to the development position P1 to carry out the development, the toner concentration of the developing roll 133 for the magenta can be measured by the toner concentration sensor 31. Also, when the developing roll 133 for the magenta is moved to the development position P1 to carry out the development, the toner concentration of the developing roll 134 for the yellow can be measured by the toner concentration sensor 31. And, when the developing roll 134 for the yellow is moved to the development position P1 to carry out the development, the concentration standard member 32 can be used to calibrate the toner concentration sensor 31.

From the above-mentioned explanation, as for the toner concentration measurements of the developing rolls 132, 133 and 134 for the colors (cyan, magenta and yellow), when the developing roll for any of the other development colors is used to develop the electrostatic latent image, all of them can be measured parallel to this. Also, as for the calibration of the toner concentration sensor 31, when the developing roll 134 for the yellow is used to develop the electrostatic latent image, it can be executed parallel to this. Thus, when the full-color image is form, in order to measure the toner concentration or calibrate the toner concentration sensor, it is not necessary to stop the rotation of the rotary developing device 13 every time. Also, even during the image forming operation, it is possible to form the image at high productivity while controlling the supply of the toner at excellent precision, in accordance with the measurement results of the toner concentration sensor 31.

Moreover, during the image forming operation, as the rotation operation angle of the rotary developing device 13, only two angles of the predetermined angle $\alpha$ and the angle $\beta$ greater than $\alpha$ exist, which consequently simplifies the rotation drive control of the rotary developing device 13. In particular, since the predetermined angle $\alpha$ is set under the condition of $\alpha=360°\div(N+1)$, the angle $\beta$ is inevitably set by $\beta=2\times\alpha$. Thus, during the image forming operation, the rotation drive control can be properly executed only by indicating the rotation operation angle of the rotary developing device 13 as the integer times of $\alpha$. Hence, it is possible to further simplify the rotation drive control.

Incidentally, when the toner concentration of the developing roll 131 for the black is measured by the toner concentration sensor 31, the developing roll 131 for the black is required to be moved to the measurement position P3 of the toner concentration sensor 31. However, typically, the toner for the black has the property of absorbing the light similarly to the carrier mixed therewith, and the reflectance of the light is low as compared with the color toners for cyan, magenta, yellow and the like. Thus, even if the optical toner concentration sensor 31 is used to measure the toner concentration, it is difficult to obtain sufficient sensitivity. For this reason, for the black, the concentration measurement that uses the toner concentration sensor 31 is not executed. Then, the other measuring method, for example, the method of using the toner for the black and generating (developing) a standard patch on the photosensitive drum 11, and then measuring the development toner amount of this standard patch by using a sensor, and further controlling the toner supply to make the development toner amount constant may be employed. Hence, even if during the image forming operation, the toner concentration of the developing roll 131 for the black is not measured by the toner concentration sensor 31, there is no substantial problem on practical use.

Furthermore, in the above-mentioned embodiment, as the configuration of the rotary developing device 13, the configuration having the 4 developing rolls 131 to 134 corresponding to the respective colors of black, cyan, magenta and yellow has been exemplified. However, the present invention is not limited thereto. Other than the 4 developing rolls, the configuration having the developing roll for special colors, for example, such as silver and gold, may be used.

In the first image forming apparatus having the foregoing configuration, for example, assuming that the four developer carriers corresponding to the 4 colors of KCMY are placed on the rotation orbit of the rotary developing device, when the first developer carrier is moved to the development position, the second developer carrier is placed at the measurement position of the toner concentration sensor, and when the second developer carrier is moved to the development position, the third developer carrier is placed at the measurement position of the toner concentration sensor, and when the third developer carrier is moved to the development position, the fourth developer carrier is placed at the measurement position of the toner concentration sensor. Thus, when the first developer carrier is used to develop the electrostatic latent image, the toner concentration of the second developer carrier may be measured by the toner concentration sensor, and when the second developer carrier is used to develop the electrostatic latent image, the toner concentration of the third developer carrier may be measured by the toner concentration sensor, and when the third developer carrier is used to develop the electrostatic latent image, the toner concentration of the fourth developer carrier can be measured by the toner concentration sensor.

Also, in the first image forming apparatus, if a home position of the rotary developing device is set at a position separated at the same angle as the first angle in the rotation direction of the rotary developing device from the first developer carrier, when the home position of the rotary developing device is moved to the development position, the first developer carrier is placed at the measurement position of the toner concentration sensor. Thus, when the home position of the rotary developing device is returned to the development position, the toner concentration of the first developer carrier may be measured by the toner concentration sensor.

Also, in the unit including the four developer carriers corresponding to the 4 colors of KCMY, if the first developer carrier is used for black, the toner concentrations of the developer carriers for the colors such as cyan, magenta and yellow can be measured by the toner concentration sensor, when each of the other developer carriers is used to develop the electrostatic latent image. Also, when the home position of the rotary developing device is returned to the development position, the toner concentration of the developer carrier for the black may be measured by the toner concentration sensor. For example, in the case where the development color order of the rotary developing device is set in the order of KCMY, when the developer carrier for the black serving as the first color is used to develop the electrostatic latent image, the toner concentration of the developer carrier for the cyan serving as the second color may be measured by the toner concentration sensor. Also, when the developer carrier for the cyan serving as the second color is used to develop the electrostatic latent image, the toner concentration of the developer carrier for the magenta serving as the third color may be measured by the toner concentration sensor. When the developer carrier for the magenta serving as the third color is used to develop the electrostatic latent image, the toner concentration of the developer carrier for the yellow serving as the fourth color may be measured by the toner concentration sensor. Moreover, when the home position of the rotary developing device is returned to the development position, the toner concentration of the developer carrier for the black serving as the first color may be measured by the toner concentration sensor.

In the second image forming apparatus having the foregoing configuration, for example, assuming that the four developer carriers corresponding to the 4 colors of KCMY are placed on the rotation orbit of the rotary developing device, when the first developer carrier is moved to the development position, the third developer carrier is placed at the measurement position of the toner concentration sensor, and when the second developer carrier is moved to the development position, the fourth developer carrier is placed at the measurement position of the toner concentration sensor, and when the home position of the rotary developing device is moved to the development position, the second developer carrier is placed at the measurement position of the toner concentration sensor. Thus, when the first developer carrier is used to develop the electrostatic latent image, the toner concentration of the third developer carrier may be measured by the toner concentration sensor, and when the second developer carrier is used to develop the electrostatic latent image, the toner concentration of the fourth developer carrier can be measured by the toner concentration sensor. Also, when the home position of the rotary developing device is returned to the development position, the toner concentration of the second developer carrier may be measured by the toner concentration sensor.

Also, in the unit including the four developer carriers corresponding to the 4 colors of KCMY, if the first developer carrier is used for black, the toner concentrations of the developer carriers for the colors such as cyan, magenta and yellow can be measured by the toner concentration sensor, when each of the other developer carriers is used to develop the electrostatic latent image or when the home position of the rotary developing device is returned to the development position. For example, in the unit having the four developer carriers where the development color order of the rotary developing device is set in the order of KCMY, when the developer carrier for the black serving as the first color is used to develop the electrostatic latent image, the toner concentration of the developer carrier for the magenta serving as the third color may be measured by the toner concentration sensor. Also, when the developer carrier for the cyan serving as the second color is used to develop the electrostatic latent image, the toner concentration of the developer carrier for the yellow serving as the fourth color may be measured by the toner concentration sensor. Moreover, when the home position of the rotary developing device is returned to the development position, the toner concentration of the developer carrier for the cyan serving as the second color may be measured by the toner concentration sensor.

In the third image forming apparatus having the foregoing configuration, for example, assuming that the four developer carriers corresponding to the 4 colors of CMYK are placed on the rotation orbit of the rotary developing device, when the first developer carrier is moved to the development position, the second developer carrier is placed at the measurement position of the toner concentration sensor, and when the second developer carrier is moved to the development position, the third developer carrier is placed at the measurement position of the toner concentration sensor, and when the home position of the rotary developing device is moved to the development position, the first developer carrier is placed at the measurement position of the toner concentration sensor. Thus, when the first developer carrier is used to develop the electrostatic latent image, the toner concentration of the second developer carrier may be measured by the toner concentration sensor. Also, when the home position of the rotary developing device is returned to the development position, the toner concentration of the first developer carrier may be measured by the toner concentration sensor.

Also, in the unit including the four developer carriers corresponding to the 4 colors of CMYK, if the fourth developer carrier is used for black, the toner concentrations of the developer carriers for the colors such as cyan, magenta and yellow can be measured by the toner concentration sensor, when each of the other developer carriers is used to develop the electrostatic latent image or when the home position of the rotary developing device is returned to the development position. For example, in the unit having the four developer carriers where the development color order of the rotary developing device is set in the order of CMYK, when the developer carrier for the cyan serving as the first color is used to develop the electrostatic latent image, the toner concentration of the developer carrier for the magenta serving as the second color may be measured by the toner concentration sensor. Also, when the developer carrier for the magenta serving as the second color is used to develop the electrostatic latent image, the toner concentration of the developer carrier for the yellow serving as the third color may be measured by the toner concentration sensor. Moreover, when the home position of the rotary developing device is returned to the development position, the toner concentration of the developer carrier for the cyan serving as the first color may be measured by the toner concentration sensor.

In the image forming apparatus according to an aspect of the present invention, for example, let us suppose that the 4 developer carriers are placed in the rotary developing device, in the manner corresponding to the 4 colors of KCMY. Consequently, those 4 developer carriers are placed on the rotation orbit of the rotary developing device, in turn, in an order starting from the first developing roll to the fourth developing roll, rotating oppositely in the rotation direction of the rotary developing device. Then, when the first developer carrier is moved to the development position, the second developer carrier is placed at the measurement position of the toner concentration sensor. When the second developer carrier is moved to the development position, the third developer carrier is placed at the measurement position of the toner concentration sensor. When the third developer carrier is moved to the development position, the fourth developer carrier is placed at the measurement position of the toner concentration sensor. And, when the fourth developer carrier is moved to the development position, the concentration standard member is placed at the measurement position of the toner concentration sensor. Thus, when the first developer carrier is moved to the development position to carry out the development, the toner concentration of the second developer carrier may be measured by the toner concentration sensor. When the second developer carrier is moved to the development position to carry out the development, the toner concentration of the third developer carrier may be measured by the toner concentration sensor. And, when the third developer carrier is moved to the development position to carry out the development, the toner concentration of the fourth developer carrier can be measured by the toner concentration sensor. Then, when the fourth developer carrier is moved to the development position to carry out the development, the concentration standard member may be used to calibrate the toner concentration sensor.

According to an aspect of the present invention, on the rotation orbit of the rotary developing device, even if the angular interval between some of the developer carriers is made wider than that between the other units, it is possible to optimize the positional relationship between each of the developer carriers and the toner concentration sensor, simplify the rotation drive control of the rotary developing device and improve the productivity of the image formation.

According to an aspect of the image forming apparatus of the present invention, it may be possible to optimize the positional relationship between the developer carriers for the respective colors, the toner concentration sensor and the concentration standard member, in the rotation direction of the rotary developing device, and may simplify the rotation drive control of the rotary developing device and may improve the productivity of the image formation.

The entire disclosure of Japanese Patent Applications Nos. 2005-185950 and 2005-185951 filed on Jun. 27, 2005 including specification, claims, drawings and abstract is incorporated herein by reference in its entirety.

What is claimed is:

1. An image forming apparatus comprising:

an image carrier on which an electrostatic latent image is formed;

a rotary developing device having N developer carriers, where N defines a total number of developer carriers, on a rotation orbit, the N developer carriers carrying developers to develop the electrostatic latent image, and the rotary developing device moves in turn the N developer carriers to a development position opposite to the image carrier; and a toner concentration sensor that measures toner concentrations of the developers carried in the developer carriers, a measurement position of the toner concentration sensor is set on a second virtual straight line, the second virtual straight line having a first angle toward a first virtual straight line in an opposite direction to a rotation direction of the rotary device, the first virtual straight line connecting a rotation center of the rotary developing device and the development position, and the N developer carriers are placed in turn in an order starting from a first developer carrier to an N-th developer carrier at the same angular interval as the first angle in the opposite direction to the rotation direction of the rotary developing device, and an angular interval between the N-th developer carrier and the first developer carrier is set to a second angle greater than the first angle.

2. The image forming apparatus according to claim 1, wherein a home position of the rotary developing device is set at a position separated at the same angle as the first angle in the rotation direction of the rotary developing device from the first developer carrier.

3. The image forming apparatus according to claim 1, wherein the rotary developing device switches development colors by rotating the developer carriers, and the color of the first developer carrier is black.

4. The image forming apparatus according to claim 1, further comprising:

a concentration standard member placed together with the developer carriers on the rotation orbit of the rotary developing device in order to calibrate the toner concentration sensor, wherein the concentration standard member is placed at a position which is separated at the same angle as a predetermined angle from the N-th developer carrier.

5. The image forming apparatus according to claim 4, wherein the predetermined angle is set to $^{360°}/_{(N+1)}$.

6. The image forming apparatus according to claim 4, wherein the rotary developing device switches development colors by rotating the developer carriers, and the color of the first developer carrier is black.

* * * * *